US008247695B2

(12) United States Patent
Nakamura et al.

(10) Patent No.: US 8,247,695 B2
(45) Date of Patent: Aug. 21, 2012

(54) HIGH FREQUENCY LEAKAGE CURRENT RETURN WIRE-CONTAINED MOTOR DRIVE CABLE, LOW INDUCTANCE RETURN WIRE-CONTAINED UNSHIELDED CABLE, AND MOTOR DRIVE CONTROL SYSTEM USING THE CABLES

(75) Inventors: Masanobu Nakamura, Kawasaki (JP); Keiji Munezuka, Kawasaki (JP)

(73) Assignees: Oki Electric Cable Co,. Ltd., Kanagawa (JP); Fanuc Ltd., Yamanashi (JP)

( * ) Notice: Subject to any disclaimer, the term of this patent is extended or adjusted under 35 U.S.C. 154(b) by 641 days.

(21) Appl. No.: 12/443,743

(22) PCT Filed: Oct. 2, 2007

(86) PCT No.: PCT/JP2007/069301

§ 371 (c)(1),
(2), (4) Date: Mar. 31, 2009

(87) PCT Pub. No.: WO2008/041708

PCT Pub. Date: Apr. 10, 2008

(65) Prior Publication Data

US 2010/0097023 A1 Apr. 22, 2010

(30) Foreign Application Priority Data

Oct. 2, 2006 (JP) ..... 2006-270336

(51) Int. Cl.
*H01B 7/00* (2006.01)

(52) U.S. Cl. ..... 174/113 R

(58) Field of Classification Search ..... 174/36, 174/110 R, 113 R, 102 R, 106, 108
See application file for complete search history.

(56) References Cited

U.S. PATENT DOCUMENTS

| | | | | |
|---|---|---|---|---|
| 4,552,432 | A * | 11/1985 | Anderson et al. | 385/101 |
| 5,834,699 | A * | 11/1998 | Buck et al. | 174/113 R |
| 6,903,277 | B2 * | 6/2005 | Whidden | 174/106 R |
| 7,288,721 | B2 * | 10/2007 | Varkey et al. | 174/102 R |
| 2003/0168229 | A1 * | 9/2003 | Whidden | 174/35 C |

FOREIGN PATENT DOCUMENTS

| | | |
|---|---|---|
| JP | 2002-208318 | 7/2002 |
| JP | 2002-245860 | 8/2002 |
| JP | 2002-298662 | 10/2002 |
| JP | 2005-267873 | 9/2005 |

OTHER PUBLICATIONS http://okidensen.co.jp/prod/cable/robot/orv.html.
http://www.hitachi-cable.co.jp/catalog/H-001/pdf/07g_02_densan.pdf.
"Report Regarding High Tension Inverter-Used Cables" EMC-Countermeasure Technique WG for High Tension Inverter Cables, The Japan Electrical Manufacturers' Association, Jan. 27, 2005.
Bentley et al., "Evaluation of Motor Power Cables for PWM AC Drives" IEEE Transaction on Industry Applications, vol. 33, No. 2, pp. 342-358, Mar./Apr. 1997.

* cited by examiner

*Primary Examiner* — William Mayo, III
(74) *Attorney, Agent, or Firm* — Dickstein Shapiro LLP

(57) ABSTRACT

A high frequency (HF) leakage current return wire-contained motor drive cable configured in a manner that one or multiple drive dielectric core wires and one or multiple HF leakage current return wires are arranged adjacent to and in close contact. Concurrently, the drive dielectric core wires and the HF leakage current return wires are arranged substantially parallel to the longitudinal direction and are stranded; and a sheath is provided without a shield being provided outside of the strand wires.

52 Claims, 15 Drawing Sheets

FIG. 5

| ITEM | | | USE EXAMPLE |
|---|---|---|---|
| MOTOR DRIVE INSULATED WIRE | CONDUCTOR | | STRAND-WIRE CONDUCTOR, COMPRESSED CONDUCTOR, AND SINGLE WIRE ETC. |
| | INSULATOR | ORDINARY | PVC ETC. |
| | | LOW DIELECTRIC CONSTANT | PTFE, PE, AND FOAM PE ETC. |
| HF LEAKAGE CURRENT RETURN WIRE | CONDUCTOR | | STRAND-WIRE CONDUCTOR, COMPRESSED CONDUCTOR, AND SINGLE WIRE ETC. |
| | INSULATOR (ALSO WIRE WITHOUT INSULATOR IS POSSIBLE) | ORDINARY | PVC ETC. |
| | | LOW DIELECTRIC CONSTANT | PTFE, PE, AND FOAM PE ETC. |
| MOTOR NEUTRAL WIRE (GROUND WIRE) | CONDUCTOR | | STRAND-WIRE CONDUCTOR, COMPRESSED CONDUCTOR, AND SINGLE WIRE ETC. |
| | INSULATOR | ORDINARY | PVC ETC. |
| | | LOW DIELECTRIC CONSTANT | PTFE, PE, AND FOAM PE ETC. |
| SHIELD | | | BRAIDED SHIELD AND ALUMINIUM TAPE ETC. |
| SHEATH | | | PVC AND PE ETC. |

LOOP INDUCTANCE OF LOW INDUCTANCE RETURN WIRE-CONTAINED UNSHIELDED CABLE (WHEN RETURN WIRE CROSS-SECTIONAL AREA SIZE IS 1/3 CROSS-SECTIONAL AREA SIZE OF DRIVE WIRE)

FIG. 10

| | CONVENTIONAL | | | PRESENT INVENTION | | | | |
|---|---|---|---|---|---|---|---|---|
| | SECOND TYPE UNSHEILDED CABLE | THIRD TYPE SHEILDED CABLE NO. 1 | THIRD TYPE SHEILDED CABLE NO. 2 | FIRST EMBODIMENT | SECOND EMBODIMENT | THIRD EMBODIMENT | FIRST EMBODIMENT NO. 1 | FIRST EMBODIMENT NO. 2 |
| CABLE STRUCTURE | 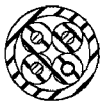 UNSHIELDED | 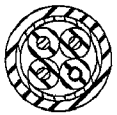 SHIELDED | 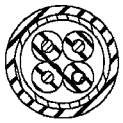 SHIELDED | 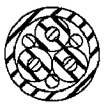 RETURN WIRE | 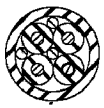 RETURN WIRE | 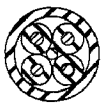 RETURN WIRE | 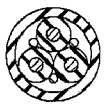 RETURN WIRE | 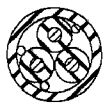 RETURN WIRE |
| EVALUATION EXAMINATION RESULT NOISE CURRENT A | 0.90 | 0.50 | 0.70 | 0.40 | 0.45 | 0.50 | 0.50 | 0.70 |
| LOOP INDUCTANCE VALUE OBTAINED BY SIMULATION μ H/m | 0.804 | 0.310 | 0.400 | 0.302 | 0.306 | 0.310 | 0.310 | 0.398 |

HIGH FREQUENCY LEAKAGE CURRENT RETURN WIRE-CONTAINED MOTOR DRIVE CABLE, LOW INDUCTANCE RETURN WIRE-CONTAINED UNSHIELDED CABLE, AND MOTOR DRIVE CONTROL SYSTEM USING THE CABLES

FIELD OF THE INVENTION

The present invention relates to a high frequency (HF) leakage current return wire-contained motor drive cable. More specifically, the present invention relates to a HF leakage current return wire-contained drive cable in which, in the event of controlling a motor by using an inverter, the loop inductance of a return wire is reduced to efficiently return to the side of the inverter a HF leakage current occurring on the side of the motor because of HF switching pulses associated with an inverter. The present invention further relates to a HF leakage current return wire-contained motor drive cable in which also increase in capacitance is inhibited.

More specifically, the present invention relates to a low inductance return wire-contained motor drive cable in which, in the event of performing drive control of a motor or being driven control device, by using an inverter, the loop inductance of a return wire is reduced to return to the side of an inverter the HF leakage current occurring because of HF switching pulses associated with the inverter by inhibiting the HF leakage current from flowing to a housing earth. The unshielded cable is a cable having a structure in which a shield is not provided to the inner side of a sheath.

The present invention further relates to a system in which an inverter and a motor, which is a driven control device being driven by the motor, are interconnected by a HF leakage current return wire-contained drive cable having a reduced inductance to thereby efficiently return to the side of the inverter a HF leakage current occurring on the side of the motor because of HF switching pulses associated with the inverter. The present invention further relates to a system in which also the increase in capacitance is inhibited and the rise and fall of the switching pulse are prevented from blunting, thereby to efficiently return the HF leakage current to the side of the inverter.

The present invention further relates to any one of a numerically controlled machine, robot, or injection molding machine that uses the HF leakage current return wire-contained motor drive cable as a power cable for a motor.

BACKGROUND ART

Three-phase motor cables are ordinarily manufactured and sold in many makers. In factories of the present Applicant as well, the motor cables are sold as, for example, robot cables (ORV Cable Series) (See Non-patent Publication 1). As a generally integrated catalog, a "general cable guidebook" issued by Hitachi Cable Ltd., for example, discloses various cable structures. Not only those disclosed therein, but also various other cable structures are publicly disclosed by many other makers.

In a broad sense, conventionally known three-phase motor drive cables, such as described above, are primarily classified into cables of three types, as shown in FIGS. 15(A), 15(B), and 15(C). FIG. 15(A) shows a conventional first type cable 1-1 (or, "cable structure 1-1" hereinafter). As shown therein, the first type cable 1-1 has a cable structure including three motor drive insulated wires 2, respectively, formed with an insulator 4 provided onto conductors 3. A sheath 8 is provided on the above-described, but no shield is provided thereon.

FIG. 15(B) shows a conventional second type cable (or, "cable structure 1-2" hereinafter) 1-2. As shown therein, the second type cable 1-2 has a cable structure that includes three motor drive insulated wires 2 (U, V, and W), respectively, formed with the insulator 4 provided on conductors 3. In addition, a neutral wire (with the insulator 4 provided thereon) is arranged (the ground wire is a conductor on the side maintained to the ground potential, which ordinarily is alternatively called as a "ground wire," and is a ground wire for the purpose of security). A sheath 8 is provided to surround the wires, but no shield is provided thereon. FIG. 15(C) shows a conventional third type cable 1-3. As shown therein, the third type cable 1-3 has a cable structure that includes three motor drive insulated wires 2, respectively, formed with the insulator 4 provided on conductors 3. In addition, the ground wire 6 (with the insulator 4 provided thereon) is arranged. A shield 7 is provided on the outer circumference of the above-described, and a sheath 8 is provided to surround the wires.

Further, although having not actually appeared on the market, cable structures described hereinafter are also known (see Non-patent Publications 3 and 4). FIG. 15(D) shows a conventional fourth type cable 1-4. As shown therein, the fourth type cable 1-4 has a cable structure including three motor drive dielectric core wires 2, respectively, formed with the insulator 4 provided onto conductors 3. A shield 7 is arranged to the above-described and a sheath 8 is provided thereon. As the last one, FIG. 15(E) shows a conventional fifth type cable 1-5. As shown therein, the fifth type cable 1-5 has a cable structure including three motor drive dielectric core wires 2, respectively, formed with the insulator 4 provided onto conductors 3. Further, three security ground wires 9 each provided with the insulator 4, a shield 7 is provided on the outer circumference thereof, and a sheath 8 is provided to surround the wires.

The present invention (and embodiments thereof) will be described using terms defined as follows. The term "conductor" refers a metal portion (generally, a portion of aluminum or copper) that allows electricity to travel or pass through, and that is an open conductor wire configured from a single wire or a strand wire (an aggregate of multiple wires). The term "insulated wire" refers to a wire that jacketed with an insulator, and that generally is provided without a sheath (outer protection jacket). The term "core" or "core wire" refers to an insulated wire formed by providing an insulator on a conductor (single wire or strand wire). The term "cable" refers to a wire formed in the manner that the core or core wire is single-stranded or multi-stranded, and a sheath is provided to surround the wires.

Non-patent Publication 1: http://www.okidensen.co.jp/prod/cable/robot/orv.html

Non-patent Publication 2: http://www.hitachi-cable.co.jp/catalog/H-001/pdf/07g_02_densan.pdf Non-patent Publication 3: "Report Regarding High Tension Inverter-Used Cables", Jan. 27, 2005, EMC-Countermeasure Technique WG for High Tension Inverter Cables, The Japan Electrical Manufacturers' Association Non-patent Publication 4: "Evaluation of Motor Power Cables for PWM AC Drives" John. M. Bentley and Patrick J. Link, IEEE TRANSACTION ON INDUSTRY APPLICATIONS VOL. 33, NO. 2, MARCH/APRIL 1997

DISCLOSURE OF THE INVENTION

Problems to be Solved by the Invention

In Non-patent Publication 3 (pp. 29) listed above, "three-strand shield cable (copper or aluminum shield) three-strand ground cable including a three-strand grounding cable," there is described to the effect that "a three-strand ground wire works not only for equipment grounding, but also as a return path for a surge propagating through a primary circuit, so that noise scatter can be inhibited." Regarding a "three-strand copper shield cable (in which the copper shield is thicker than ordinarily ones)," there is described to the effect that "in the cable, by using a shield having a larger cross-sectional area size than ordinarily cables, the impedance of the shield is reduced to prevent noise scatter." Thus, there is described to the effect that a shield, or more specifically, a shield thicker than ordinarily ones is necessary in order to prevent noise scatter.

Conventionally, since the rise of the pulse of the motor drive power is slow, no big problems have occurred. Recently, however, the influence of the stray capacitance in the motor has begun to appear in association with increased speeds and efficiency of the inverter. This can cause a risk that a HF leakage current occurs to thereby cause malfunction of a peripheral device, such as an encoder, other than devices from an inverter to a driver circuit for the motor.

The above is caused for the following reasons. In the conventional first type cable structure 1-1 in which only three drive insulated wires 2 are arranged, when grounding is not sufficient, there is a security problem in that leakage current occurs in the motor. Hence, there has been used the configuration having the second type cable structure 1-2 in which the ground wire 6 is provided. This is attributed to the facts described hereinafter. The cable structure (1-2) is, by nature, designed for the primary purpose of security, such that the HF leakage current is not almost taken into account. However, in the situation of motor drive systems using an inverter for driving the motor, since the HF impedance is so high that the HF leakage current countermeasure using only the ground wire is not necessarily sufficient. More specifically, with regard to the unshielded cable, even in the case where three motor drive insulated wires 2 and one ground line 6 are employed, the amount of noise is large. Hence, not only the influence of leakage to other devices from a bearing or the like of the motor is significant, but also a recovery percentage of noise current being collected through cables is low. As such, it cannot be said that the HF leakage current countermeasure is not necessarily sufficient.

As such, conventionally, there has been inevitably used the configuration having the third type cable structure 1-3 in which three motor drive insulated wires 2 and the ground wire 6 are arranged, and the shield 7 is provided on the outer circumference of the wires (i.e., the shield 7 is provided to surround the wires). Consequently, in the case of the shielded cable structure, the recovery percentage of noise current is increased. Hence, the amount of noise is reduced, and the amounts of noise leaking to other peripheral devices are reduced, thereby making it possible to solve the technical problem of noise current recovery. However, the cable having the above-described configuration, in which three motor drive insulated wires 2 and the ground wire 6 are arranged, and the shield 7 is provided on the outer circumference of the wires, has drawbacks in that the cable is expensive, lacks flexibility, and is low in terminal workability. As shown in FIG. 15(D), the shielded fourth type cable structure 1-4 also is a simple cable structure in which three motor drive insulated wires 2 are arranged, and the shield 7 is provided. Similar to the third type cable structure, since the shield is provided, there remains the drawbacks in that the structure is expensive, lacks flexibility, and is low in the terminal workability. Further, in order to implement shield-used noise scatter prevention, the cable having this structure has to use a shield larger in cross-sectional area size than ordinarily cables.

The last one of the shown conventional cable structure types is the shielded fifth type cable structure 1-5 in which the three security ground wires 9 provided with the insulator are provided in the conventional fourth type cable structure 1-4 (FIG. 15(D)). In this case, since the shield is provided, drawbacks similar to the above are posed. Further, reference is now made to Non-patent Publication 3 (pp. 29, FIG. 3-1 "Example of Three-Strand Shielded Cable Including Three-Strand Grounding Cable") and to Non-patent Publication 4 (pp. 357, FIG. 21). As shown therein, it is apparent that, in the structure, the respective security ground wires 9 are jacketed with the insulator. However, the present invention is not originally made from the technical idea of providing, as one issue, the HF leakage current countermeasure for reducing the loop inductance. In other expression, the present invention is not originated to include the technical idea of arranging the three drive insulated wires to be intimately adjacent to the respective security ground wires 9 in the relationship of distance. However, the present invention is rather characterized in that it does not matter at all whatever the mutual arrangement distance may be, inasmuch as the wires are provided simply within the cable.

From the above, the conventional motor drive cables can be summarized as follows. In the case of either the unshielded cable either including only three wires, i.e., three drive insulated wires or including four wires including one ground wire, the HF leakage current countermeasure is insufficient. Even in the latter cable including the ground wire, the ground wire is provided for the primary purpose of security, so that HF leakage current countermeasure is insufficient. Hence, it has been inevitable to employ the structure including the thick shield having the large cross-sectional area size (even in this case, there has been no technical idea of configuring a return path with a reduced loop inductance). A cable having a shield such as described above has the drawbacks of the expense, the lack of flexibility, and low terminal workability. The fifth type cable structure also has similar drawbacks.

As described above, conventional drive cables include those of the type including a ground wire and a thick shield having a great cross-sectional area size. However, the ground wire is, by nature, used for security, and the shield is used for the purpose of a radiation noise countermeasure. However, in view of the fact that, in recent years, especially since inverter driven motors became used with, for example, numerically controlled devices, the inventors have learned that the HF leakage current countermeasure, and have decided to make the present invention.

Means for Solving the Problems

As a first example of the present invention, a high frequency (HF) leakage current return wire-contained motor drive cable is characterized by being configured in a manner that a plurality of drive insulated wires and one or a plurality of HF leakage current return wires are arranged adjacent to and in close contact in neighborhoods thereof to thereby reduce inductances of the HF leakage current return wires; the drive insulated wires and the HF leakage current return wires are arranged substantially parallel to a longitudinal direction and are stranded; and a sheath is provided without a shield being provided outside of the strand wires.

As a second example of the present invention, a HF leakage current return wire-contained motor drive cable is characterized by being configured in a manner that a plurality of drive insulated wires and one or a plurality of HF leakage current return wires are arranged adjacent to and in close contact in neighborhoods thereof to thereby reduce inductances of the HF leakage current return wires; an ground wire is added thereto; the drive insulated wires, the HF leakage current return wires, and the ground wire are arranged substantially parallel to a longitudinal direction and are stranded; and a sheath is provided without a shield being provided outside of the strand wires.

Further, as a third example of the present invention, the HF leakage current return wire-contained motor drive cable is characterized in that the HF leakage current return wires are each configured from only a conductor not insulated.

Further, as a fourth example of the present invention, the HF leakage current return wire-contained motor drive cable is characterized in that the HF leakage current return wires are each configured from a conductor jacketed with an ordinarily insulator or a low dielectric constant insulator around the conductor.

Further, as a fifth example of the present invention, the HF leakage current return wire-contained motor drive cable is characterized in that a low dielectric constant insulators is as an insulator of the drive insulated wire and the ground wire.

As a sixth example of the present invention, a HF leakage current return wire-contained motor drive cable is characterized by being configured in a manner that a plurality of drive insulated wires and one or a plurality of HF leakage current return wires are arranged adjacent to and in close contact in neighborhoods thereof to thereby reduce inductances of the HF leakage current return wires; the drive insulated wires and the HF leakage current return wires are arranged substantially parallel to a longitudinal direction and are stranded; a shield is provided outside of the strand wires; and a sheath is provided outside of the shield.

As a seventh example of the present invention, a HF leakage current return wire-contained motor drive cable is characterized by being configured in a manner that a plurality of drive insulated wires and one or a plurality of HF leakage current return wires are arranged adjacent to and in close contact in neighborhoods thereof to thereby reduce inductances of the HF leakage current return wires; an ground wire is added thereto; the drive insulated wires, the HF leakage current return wires, and the ground wire are arranged substantially parallel to a longitudinal direction and are stranded; a shield is provided outside of the strand wires; and a sheath is provided outside of the shield.

As an eighth example of the present invention, a low inductance return wire-contained unshielded cable, characterized in that, as viewed from a cable cross-sectional direction, three insulated wires respectively are arranged independently at three apexes of a substantially equilateral triangle, and three return wires respectively are arranged in external portions of valley portions of an assembly formed from the three insulated wires at three apexes of a substantially equilateral triangle to be adjacent to and in close contact with the motor drive insulated wires in neighborhoods thereof, thereby to reduce inductances of loop circuits configured from the respective insulated wires and return wires; the three insulated wires and the three return wires are arranged substantially parallel to a longitudinal direction and are stranded along the same direction; and a sheath is provided without a shield being provided outside of the strand wires.

As a ninth example of the present invention, a low inductance return wire-contained unshielded cable is characterized by including three insulated wires and one ground wire, wherein one or a plurality of return wires are arranged adjacent to and in close contact with an outer circumference of any one of the three insulated wires in neighborhood thereof to thereby reduce inductances of loop circuit configured from the insulated wires and the return wires; the three drive insulated wires, the one or the plurality of return wires, and the one ground wire are arranged substantially parallel to a longitudinal direction and are stranded; and a sheath is provided without a shield being provided outside of the strand wires.

As a 10th example of the present invention, a low inductance return wire-contained unshielded cable is characterized in that, as viewed from a cable cross-sectional direction, three insulated wires respectively are arranged independently at three apexes of a substantially equilateral triangle, and three return wires not each provided with an insulative sheath are arranged in a central portion of the three insulated wires, thereby to reduce inductances of loop circuits configured from the insulated wires and return wires.

As an 11th example of the present invention, a HF leakage current return wire-contained drive cable for interconnecting an inverter and a driven control device is characterized by being configured in a manner that a plurality of drive insulated wires and one or a plurality of HF leakage current return wires not each jacketed with an insulative sheath are adjacently arranged substantially parallel to a longitudinal direction and are stranded, and a sheath is provided without a shield being provided outside of the strand wires, wherein the inverter and the driven control device are interconnected by the drive cable to thereby reduce inductances of loop circuits configured from the respective insulated wires and return wires, thereby to form the HF leakage current return wire as a return path of the HF leakage current from the driven control device to the inverter.

Further, as a 12th example of the present invention, the HF leakage current return wire-contained drive cable is characterized in that one ground wire is added to the plurality of drive insulated wires are adjacently arranged substantially parallel to the longitudinal direction.

Further, as a 13th example of the present invention, the HF leakage current return wire-contained drive cable is characterized in that the HF leakage current return wire is arranged adjacent to and in close contact with the motor drive insulated wire in neighborhoods of outer circumferences of sheaths of the respective drive insulated wires each provided with an insulative sheath in a manner that an increase in capacitor is inhibited with a wire formed by jacketing an outer circumference of a conductor with an insulator or low dielectric constant insulator.

As a 14th example of the present invention, a HF leakage current return wire-contained motor drive cable for interconnecting an inverter and a driven control device is characterized by being configured in a manner that, as viewed from a cable cross-sectional direction, three insulated wires respectively are arranged independently at three apexes of a substantially equilateral triangle, three HF leakage current return wires respectively are arranged at three apexes of a substantially equilateral triangle, the three HF leakage current return wires are arranged to be adjacent to and in close contact with the motor drive insulated wires in neighborhoods thereof, and the wires thus arranged are stranded, and a sheath is provided without a shield being provided outside of the strand wires, wherein the inverter and the driven control device are interconnected by the drive cable to thereby reduce inductances of loop circuits configured from the respective insulated wires and return wires, thereby to form the HF leakage current return wires as return paths of the HF leakage current from the driven control device to the inverter.

Further, as a 15th example of the present invention, the HF leakage current return wire-contained motor drive cable is characterized in that a loop inductance L of the respective HF leakage current return wire configuring the loop circuit is caused to be as small as 0.4 μH/m or below, and more preferably 0.31 μH/m or below.

Further, as a sixteenth example of the present invention, the HF leakage current return wire-contained motor drive cable configured from the three drive insulated wires and the three HF leakage current return wires arranged adjacent to and in close contact with the respective motor drive insulated wires in the neighborhoods of the drive insulated wires is characterized in that, where a conductor cross-sectional area size of respective one of the three drive insulated wires is S, a conductor cross-sectional area size P of the respective current return wire is caused to fall within a range defined by expression (1):

$$P/3<S\leqq P \quad (1)$$

Further, as a 13th example of the present invention, the HF leakage current return wire-contained drive cable is characterized in that the HF leakage current return wire is arranged adjacent to and in close contact with the motor drive dielectric core wire in neighborhoods of outer circumferences of sheaths of the respective drive dielectric core wires each provided with an insulative sheath in a manner that an increase in capacitance is inhibited with a wire formed by jacketing an outer circumference of a conductor with an insulator or low dielectric constant insulator.

Further, as an 18th example of the present invention, the HF leakage current return wire-contained motor drive cable configured from the three drive insulated wires and the three HF leakage current return wires arranged adjacent to and in close contact with the respective motor drive insulated wires in the neighborhoods of the drive insulated wires is characterized in that, where a straight line interconnecting the center O of the triangle to the center of the respective HF leakage current return wire in the case where the respective HF leakage current return wire is arranged in contact with both of two adjacent drive insulated wires of the three drive insulated wires is a reference line, a range of a offset angle α with respect to the reference line interconnecting the center O and the center of the respective HF leakage current return wire in the case where the respective HF leakage current return wires are actually arranged is caused to fall within expression (3):

$$-5°<\alpha<+5° \quad (3)$$

As a 19th example of the present invention, a motor drive control system is characterized in that an inverter and a motor working as a driven control device to be driven by the inverter are interconnected by a HF leakage current return wire-contained drive cable in which the inductance is caused to be low, wherein a HF leakage current caused on the side of the motor due to a HF switching pulse associated with the inverter is efficiently returned by the drive cable to the side of the inverter.

As a 20th example of the present invention, a numerically controlled machine tool, robot, or injection molding machine is characterized by using the HF leakage current return wire-contained motor drive cable is used as a power cable for a motor.

EFFECTS OF THE INVENTION

According to the present invention, a low impedance with respect to a HF leakage current can be attained by a low HF loop inductance as a level in the case of a motor drive cable. Hence, an unnecessary HF leakage current occurring in a motor and flowing to a peripheral device can be returned by the motor drive cable itself to the side of an inverter. Thereby, malfunction of the peripheral device can be prevented.

Further, according to the present invention, the cable structure is simple and inexpensive and is excellent in flexibility and also in terminal workability and routing. Hence, a low inductance return wire-contained unshielded cable, which does not use a shield, can be implemented, and a drive cable having a high industrial value can be provided.

BRIEF DESCRIPTION OF THE DRAWINGS

FIG. 5 is a configuration table of the structures of HF leakage current return wire-contained motor drive cables according to the present invention.

FIG. 10 is a table of the comparison results of evaluation examinations of the respective embodiments of the present invention and conventional examples.

DESCRIPTION OF REFERENCE NUMERALS

Figure 1:
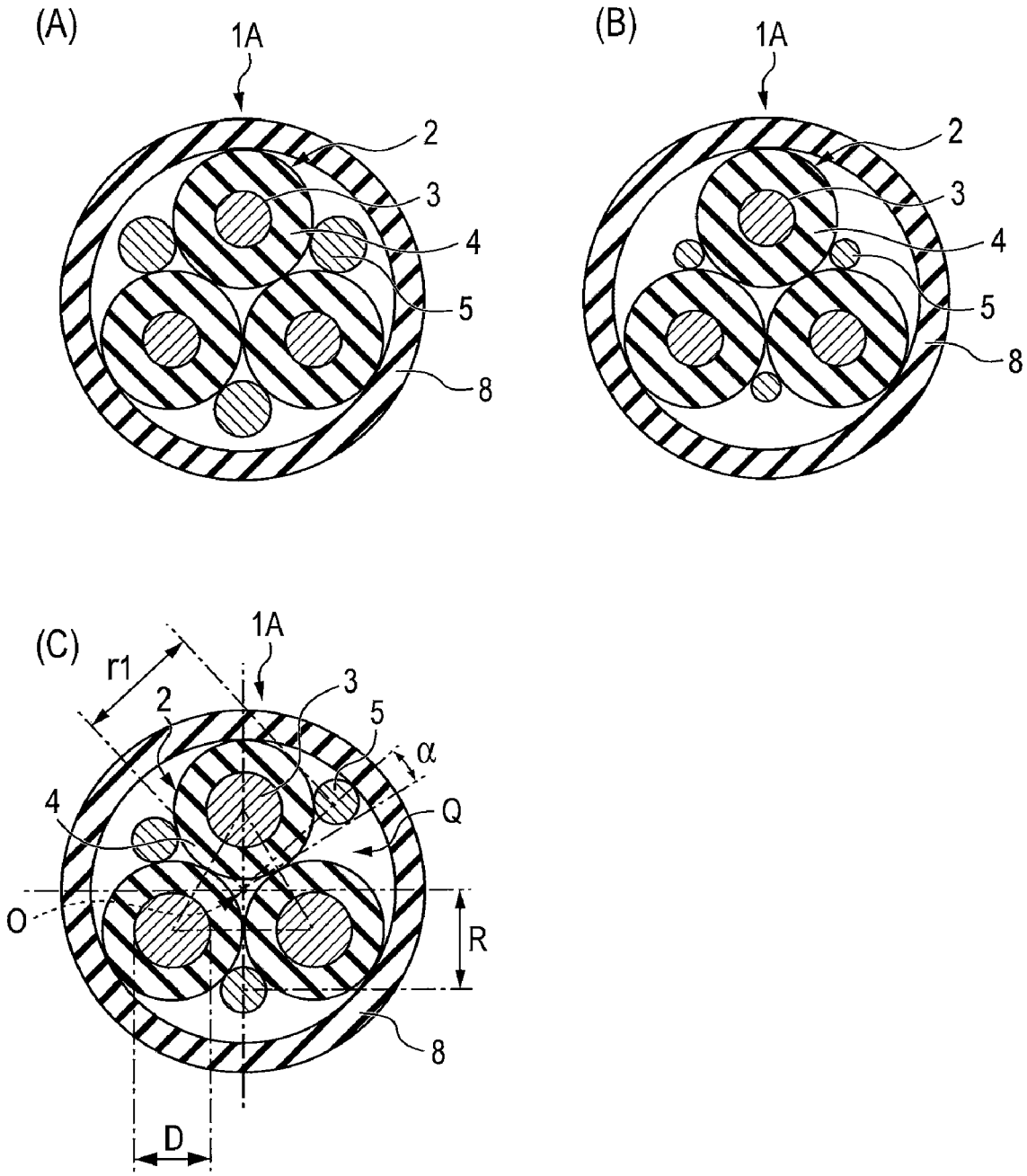
FIG. 1 shows cross sectional views showing the structures of high frequency (HF) leakage current return wire-contained motor drive cables of a first embodiment of the present invention.

1 (1A, 1B, 1C, 1D, 1E, 1F): high frequency leakage current return wire-contained motor drive cable

2: motor drive insulated wire

3: conductor

4: insulator (ordinarily insulator or low dielectric constant insulator)

5: return wire

6: ground wire

7: shield

8: sheath

As one aspect of the technical idea of the present invention, a preferred embodiment of the invention is a motor drive cable. The motor drive cable is configured in the manner that one or multiple HF leakage current return wires are arranged adjacent to and in close contact with multiple drive insulated wires in neighborhoods thereof, thereby to reduce the inductances of the HF respective leakage current return wires. This is accomplished by an unshielded structure in which the HF leakage current return wires not each jacketed with an insulative sheath are arranged adjacent to and in close contact with the respective motor drive insulated wires 2 in neighborhoods thereof, and a shield is not provided on the outer circumference.

Another embodiment of the present invention is a high frequency leakage current return wire-contained motor drive cable. The motor drive cable is configured in the manner that a ground wire is added to the wires, and the wires are arranged substantially parallel to the longitudinal direction and are stranded, and a sheath is provided on the outer circumference without a shield being provided outside. The low inductance return wire-contained motor drive cable enables implementation of a low HF impedance, is inexpensive, has flexibility, is excellent in terminal workability, and produces less radiation noise associated with leakage current.

In making the present invention, the inventors discovered that even an unshielded cable structure is effective as a HF leakage current return wire formed to include return wires not each provided with an insulative sheath that are arranged adjacent to and in close contact with the respective insulated wires 2 in neighborhoods thereof. Further, the inventors repeatedly carried out experiments in a trial and error manner, and made verification while specifying, for example, the relation between the cross-sectional area sizes of the return wire and the power insulated wire and the relation between a distance R to the return wire from the cable center and an offset angle $\alpha$. Thereby, the inventors discovered a technique for practical digitization to implement a practically usable motor drive cables.

More specifically, a preferred embodiment is a low inductance return wire-contained unshielded cable having a configuration in which, as viewed from the cable cross-sectional direction, three respective insulated wires are arranged independently at apexes of a substantially equilateral triangle. Further, three respective return wires are arranged in external portion of an assembly formed from the three insulated wires to be adjacent to and in close contact with the respective insulated wires in neighborhoods thereof. Thereby, a loop inductance of a loop circuit configured from the respective insulated wire and the respective return wire can be reduced in an appropriate balance, is inexpensive, has flexibility, and is excellent in terminal workability. Further, the cable causes less erroneous operation of a peripheral device and less radiation noise in association with a HF leakage current. This is accomplished by an unshielded structure in which the HF leakage current return wires not each jacketed with an insulative sheath are arranged adjacent to and in close contact with the respective drive insulated wires in neighborhoods thereof, and a shield is not provided on the outer circumference.

The present invention will be described in detail below with reference to a three-phase motor drive cable as a typical example by reference to the accompanying drawings.

Embodiments of the present invention will be described in detail hereinafter with reference to a low inductance return wire-contained unshielded cable by reference to the accompanying drawings.

FIG. 1(A) shows a cable structure of a first embodiment. The cable structure is configured in the manner that HF leakage current return wires 5 not each jacketed with an insulator are arranged in closely adjacent to respective motor drive insulated wires 2 formed by jacketing conductors 3 with an insulator 4, concurrently the wires are arranged substantially parallel to the longitudinal direction and are stranded, and a sheath 8 is provided outside of the strand wires. In the figure, there is shown the case where the cross-sectional area size of the conductor 3 of the motor drive insulated wire 2 is substantially the same as the cross-sectional area size of the HF leakage current return wire 5. The respective HF leakage current return wire 5 is arranged adjacent to and in close contact with the respective motor drive insulated wires 2 in neighborhoods thereof. The arrangement is thus made to form the respective return wire provided to effectively return to the side of an inverter an unnecessary HF leakage current occurring in the rise and fall of the pulse of the inverter. More specifically, in the structure, the HF leakage current return lines 5 are arranged adjacent to and in close contact with the respective motor drive insulated wires 2 in neighborhoods thereof. Hence, a loop inductance L is caused to be low, and the HF leakage current can easily flow. Further, FIG. 1(B) shows a case where the ratio between cross-sectional area size of the conductor 3 of the motor drive insulated wire 2 and the cross-sectional area size of the HF leakage current return line 5 is about 1:3.

In the present embodiment, for the insulator 4 of the motor drive insulated wire 2, while PVC is used as an ordinarily insulator, PTFE may be used as a low dielectric constant insulator. Thereby, the capacitance can be further reduced to reduce a drive power loss. FIG. 5 shows a configuration table of "structures of HF leakage current return wire-contained three-phase motor drive cables according to the present invention". As shown in the configuration table, the HF leakage current return wire 5 may be formed into a structure only with the conductors or a structure in which either an ordinarily insulator or low dielectric constant insulator is jacketed around the conductors. However, relatively preferable results were obtained in the structure only with the conductors since the conductors can be arranged in even closer contact with the respective motor drive insulated wires 2 in neighborhoods thereof.

Further, detail structures in the case where low inductance return wire-contained unshielded cables 1A (FIGS. 1(A) and 1(B)) of the first embodiment of the present invention are configured as practical cables suitable for practical use be described hereinafter in accordance with FIG. 1(C). In this case, a description is provided with reference to the case where the cross-sectional area size ratio between the cross-sectional area size of the conductor 3 of the motor drive insulated wire 2 and the cross-sectional area size of the HF leakage current return wire 5 is about 1:3 . As shown in FIG. 1(C), the unshielded cable 1A has the configuration in which, as viewed from the cable cross-sectional direction, three respective insulated wires 2, each being formed with the conductor 3 jacketed with the insulator 4, are arranged independently at apexes of a substantially equilateral triangle. Further, three respective return wires 5 not jacketed with the insulator are independently arranged in external and valley portions of an assembly formed from the three insulated wires 2 at apexes of a substantially equilateral triangle. Concurrently, the return wires 5 are arranged adjacent to and in close contact with the respective motor drive insulated wires 2 in neighborhoods thereof and in clearances (valley portions) between the three insulated wires 2. This arrangement makes it possible to accomplish the provision of the low inductance return wire-contained unshielded cable 1A configured in the manner that the loop inductance L of a loop circuit configured from the respective insulated wires 2 and return wires 5 is caused to be low, the wires are arranged substantially parallel to the longitudinal direction and are stranded along the same direction, and the sheath 8 is provided externally of the strand wire without a shield being included.

In the example case of the present invention, the three return wires 5 not jacketed with the insulator are thus arranged adjacent to and in close contact with the respective motor drive insulated wires 2 in neighborhoods thereof and in clearances (valley portions) between the three insulated wires 2. The arrangement is thus made to configure the respective return wire provided to effectively return to the side of an inverter an unnecessary HF leakage current occurring in a peripheral device, such as an encoder, in the rise and fall of a control pulse from the inverter. In the structure, the respective return wires 5 are arranged adjacent to and in close contact with the respective insulated wires 2 in neighborhoods thereof. Hence, a loop inductance L is reduced to be low, and the HF leakage current can easily flow through the three return wires 5. Further, the inventors carried out actual-use evaluation by using an actual drive cable (power cable: 0.5 $mm^2$) in the event that a motor is controlled with an inverter by using a CNC (computer numerical control), and calculation of the inductance by simulation. As a result, conditions not causing performance error with respect to a peripheral device such as an encoder were able to be clarified. As a result, for the cable structure, even in the case of an unshielded cable, it was derived that a value lower than the value "L=0.4 μH/m)" has to be attained by using a relatively long drive cable of 5 m. This value is the same as the value "L=0.4 μH/m" attained in the case of the conventional second type cable structure. Hence, in the event of performing the CNC control of the motor by using the inverter, a HF leakage current recovery percentage equivalent to that of the conventional shielded cable is necessary. More specifically, it was derived that, even in the case of the unshielded drive cable structure, in order to secure the HF leakage current recovery percentage, the value lower than the loop inductance L of 0.4 μH has be attained.

Figure 15:
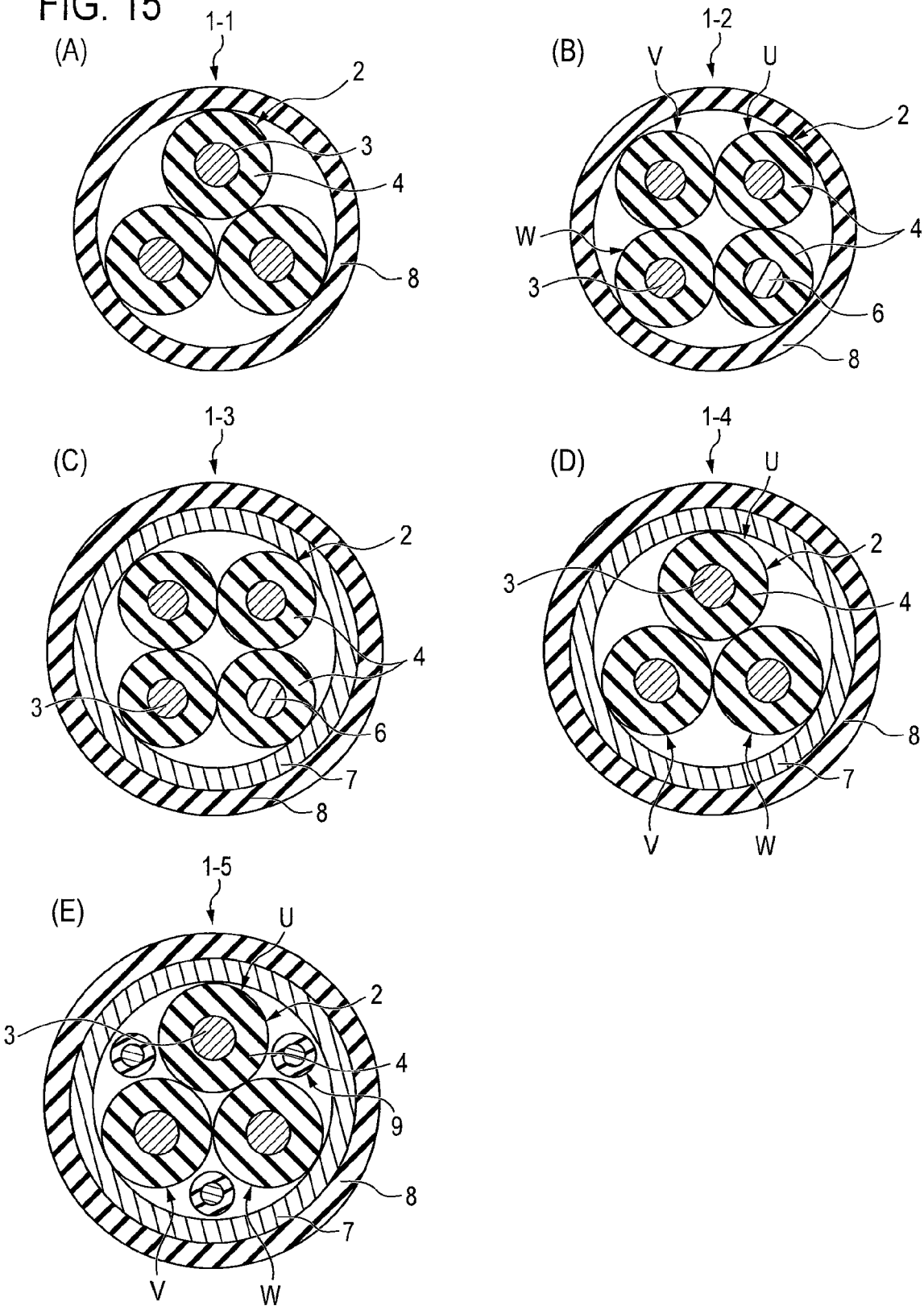
FIG. 15 shows cross sectional views showing structures of conventional motor drive cables.

The most preferable embodiment described above corresponds to a case where, as shown in FIG. 1(A) (a first embodiment of the present invention in FIG. 10). In this case, the three return wires 5 not jacketed with the insulator are ideally arranged adjacent to and in close contact with the respective motor drive insulated wires 2 in neighborhoods thereof and in clearances (valley portions) between the three insulated wires 2. More specifically, the case is that the return wire 5 not jacketed with the insulator is arranged in contact with the outer circumferential surface of the insulator 4 of any one of the adjacent insulated wires 2 in neighborhoods thereof. In this case, as the value of the loop inductance L, the calculated value obtained through the simulation was 0.302 μH/m when the cross-sectional area size of each of the insulated wire 2 and the return wire 5 is 0.5 $mm^2$. Further, a measured value for a prototype of the cable structure was 0.31 μH/m that substantially matches with the simulation result. From the above, it was found that, although manufacturing error occurs, the measured value substantially matches with the simulation-based value. Then, a verification was performed for comparison in the case of the conventional unshielded second type cable (FIG. 15(B)), which includes insulated wires each having the same cross-sectional area size as that of the first embodiment. The value of the loop inductance L obtained through the simulation was as great as 0.804 μH/m. This indicates that the security ground wire cannot function as a return path of the HF leakage current. Further, for the conventional shielded third type cable structure (FIG. 15(C)), two types of cables were evaluated. The two types are defined by a minus tolerance maximum value of the shield outside diameter (shielded third type cable No. 1) and a plus tolerance maximum value (shielded third type cable No. 2). The simulation-based calculated values were 0.310 to 0.400 μH/m. From the result, it was derived that the loop inductance L of the HF leakage current return wire configuring the loop circuit is 0.4 μH/m or below, and preferably 0.310 μH/m. As a consequence, in the case of the conventional shielded third type structure (FIG. 15(C)), it was able to obtain the effect of reduction of the loop inductance L equivalent to the low inductance return wire-contained unshielded cable 1A.

As the cases where the above-described results could be obtained are summarized, when the loop inductance L is high, the load impedance increases, so that the HF current becomes less likely to flow. Hence, the inventors discovered the structure of the unshielded cable, in which no shield is provided. In the structure, the loop inductance L is caused to be low so that the HF leakage current is caused by the cable itself to easily flow, whereby the effects of the present invention for preventing the occurrence of malfunction of a peripheral device can be obtained, and the structure is capable of withstanding practical use.

Further, in the present embodiment, for the insulator 4 of the insulated wire 2, while PVC is used as an ordinarily insulator, a low dielectric constant insulator such as PTFE may be used. This makes it possible to further reduce the capacitance to reduce the drive power loss.

Further, a practical example was verified to find a detail structure of a drive cable suitable for practical use of the low inductance return wire-contained unshielded cable 1A of the first embodiment of the present invention. As shown in FIGS. 1(A) to 1(C), in the practical example, the conductor outside diameter of the respective insulated wire 2 is represented by D, the conductor outside diameter of each of the three return wires 5 is represented by d. In addition, a ratio (s/S) of a cross-sectional area size s of the return wire 5 to a cross-sectional area size S of the respective insulated wire 2 is in a range of from 1 to 1:3 . In this case, the ratio (d/D) between a conductor outside diameter d of the return wire 5 and a conductor outside diameter D of the insulated wire 2 is $1/\sqrt{3}$. Through the execution of the verification, the low inductance return wire-contained unshielded cable for achieving the above described effects was able to be realized as an actual cable.

Bases of the verification executed for the configuration in which the ratio of the conductor cross-sectional area size of the return wire 5 to the conductor cross-sectional area size of the insulated wire 2 is in the range of from 1 to 1:3 will be described hereinafter. First of all, suppose that the ratio of the conductor cross-sectional area size of the return wire 5 to the conductor cross-sectional area size of the insulated wire 2 is 1 or greater. In this case, it is preferable to exhibit the function as the HF leakage current return path, which is one of the effects of the present invention. However, even in the case where the return wires 5 are arranged adjacent to and in close contact with the respective insulated wires 2 in neighborhoods thereof and in clearances (valley portions) between the three insulated wires 2, when the wires are stranded, the overall outside diameter is large, such that the cable is not suited for practical use. On the other hand, in the case where the ratio of the conductor cross-sectional area size of the return wire 5 to the conductor cross-sectional area size of the insulated wire 2 is small, it becomes difficult to exhibit the function as the HF leakage current return path. The inventors considered a relatively small cross-sectional area size of 0.5 $mm^2$ of the insulated wire to be a practical numeric value, and studied to seek for a conductor cross-sectional area size of the return wire 5 corresponding to the numeric value. The results of simulation-based verifications therefor were as follows. In the case where the ratio of the conductor cross-sectional area size of the return wire 5 to the conductor cross-sectional area size of the insulated wire 2 is 1/1, and the conductor cross-sectional area sizes of the insulated wire 2 and the return wire 5 are both 0.5 $mm^2$, the value of the loop inductance L was 0.302 μH/m. Further, in the case where the ratio of the conductor cross-sectional area size of the return wire 5 to the conductor cross-sectional area size of the insulated wire 2 is 1:3 , and the conductor cross-sectional area sizes of the insulated wire 2 and the return wire 5 are, respectively, both 0.5 $mm^2$ and 0.16 $mm^2$, the value of the loop inductance L was 0.310 μH/m.

Also in an actual system using the drive cable described above, no malfunction of a peripheral device occurred. In comparison, in the case of a product corresponding to the conventional shielded third type cable, a preferable value of the loop inductance L was 0.310 μH/m. Thus, the similar value of the loop inductance L can be obtained either in the case where the cross-sectional area size of the insulated wires is as relatively small as 0.5 $mm^2$ or in the case where a comparison is made between the value of the loop inductance L of the first embodiment (FIG. 1(B)) of the present invention when the ratio of the cross-sectional size of the return wire 5 to the insulated wire 2 is set to 1:3 and the value of the loop inductance L of the conventional third type cable. In comparison thereto, however, in the case of the conventional unshielded second type cable (FIG. 15(B)), the value of the loop inductance L is 0.804 μH/m, so that the cable cannot be expected to exhibit the function as the HF leakage current return path.

According to the verifications described above, in the unshielded cable structure of the first embodiment of the present invention, the loop inductance L of the conventional second type cable structure is reduced to the half value. In the case of such a level, the cable as a product is able to sufficiently withstand the use. More specifically, when a practical cable having an inductance reduction effect range in which a threshold value is ranged to 0.4 μH/m is provided, the effects of the present invention can be sufficiently expected from the cable. Further, it was proved that, even taking into account the relation to manufacturing variations of a practical product according to the first embodiment of the present invention, preferable results of the present invention can be obtained, providing that the following conditions are achieved. The conditions are that the ratio of the conductor cross-sectional area size of the return wire 5 to the conductor cross-sectional area size of the insulated wire 2 is within the range of from 1 to 1:3 , and the value of the loop inductance L is 0.4 μH/m or less.

According to the present invention, the preferable case is that, ideally, the three respective return wires 5 not jacketed with the insulator are arranged adjacent to and in close contact with the three insulated wires 2 in neighborhoods thereof and in clearances (valley portions) between the three insulated wires 2 arranged in the substantially equilateral-triangular shape. More specifically, the case is that the return wire 5 not jacketed with the insulator is arranged in contact with the outer circumferential surface of the insulator 4 of any one of the adjacent insulated wires 2 in neighborhoods thereof. However, in actual cable manufacture, there are cases in which it is not always easy to arrange the return wires 5 in the preferable positions as shown in FIG. 1(A), 1(B) over the overall cable length. As such, the inventors studied to seek for a tolerable range of the magnitude of the offset of the respective return wire 5 from the cable center to enable the value of the loop inductance L to be reduced to about 0.4 μH/m or by half relative to the case of the conventional unshielded second type cable (FIG. 15(B)). In this case, there are two types of offsets of the respective return wire 5. One is a separation distance (R; described below) of the return wire 5 from the cable center, and the other is an inclination angle (α; described below) of the return wire 5. The inventors performed verification to learn the tolerable magnitude of those values (R an α) to enable the value of the loop inductance L, which is necessary for an actual drive cable, to about 0.4 μH/m.

Reference is now made to FIG. 1(C). In the shown low inductance return wire-contained unshielded cable 1A of the first embodiment of the present invention, the separation distance can be represented by the magnitude (value) of a distance R from a center O of the three insulated wires 2. More specifically, 1 represents a reference value of the distance in the case where the respective return wire 5 is arranged in closest contact with the insulated wire 2 in neighborhoods thereof and in the clearance (valley portion) between the insulated wires 2. More specifically, the reference value is set in the case where the respective return wire 5 not jacketed with the insulator is arranged in contact with the outer circumferential surfaces of two insulated wire insulators 4 of the adjacent insulated wires 2 in neighborhoods thereof. In this case, the separation distance is represented by a ratio (distance R/reference value) of the distance R of the return wire 5 from the center O of the three insulated wires 2 to the center of the return wire 5 in the case of the manufacture of the actual cable.

Figure 6:
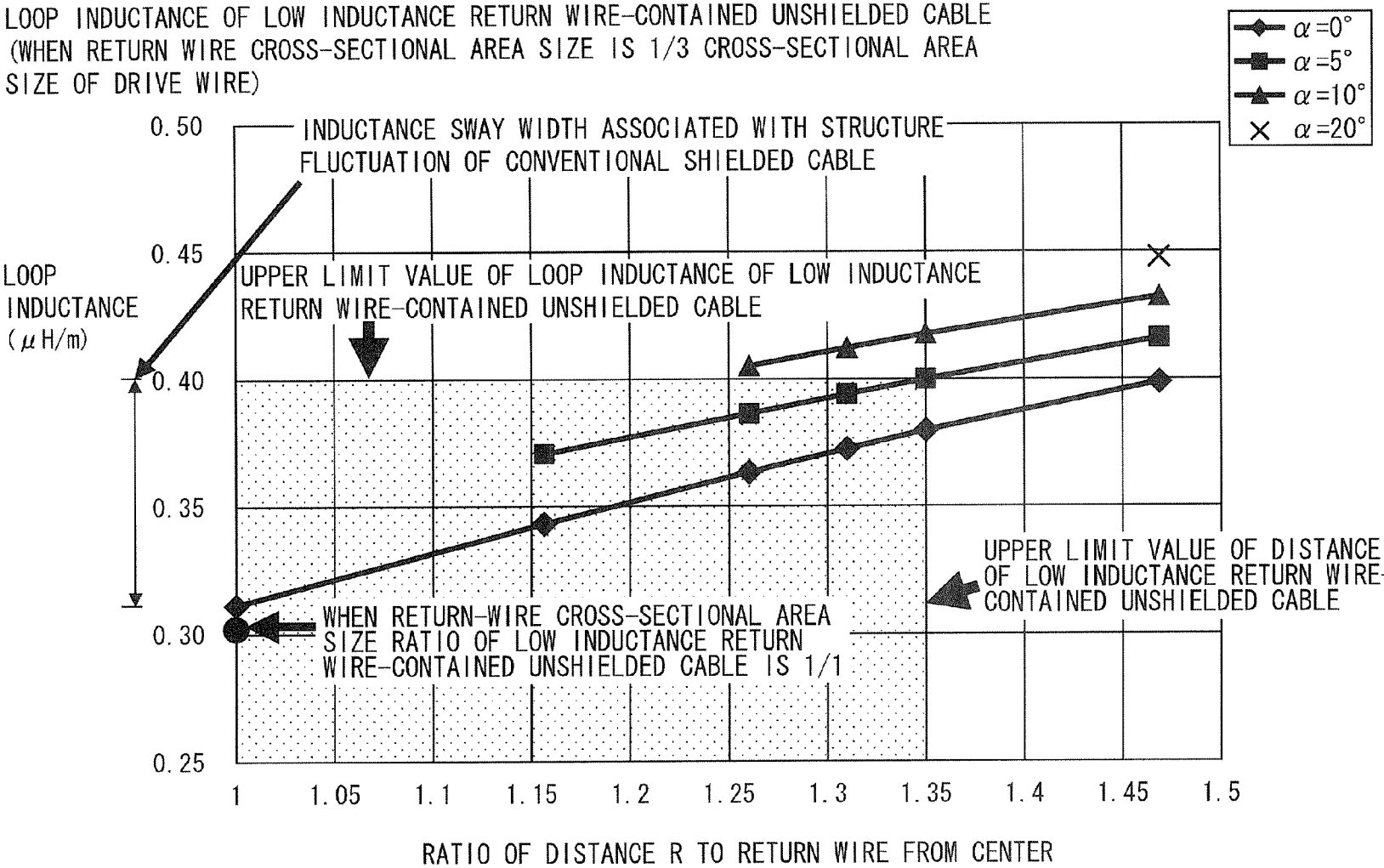
FIG. 6 is a measurement table of a loop inductance value L of the HF leakage current return wire-contained motor drive cable according to the present invention.

FIG. 6 is a graph showing plotted simulation values of the loop inductance L in the case where the conductor cross-sectional area size of the insulated wire 2 is 0.5 $mm^2$, and ratio of the conductor cross-sectional area size of the return wire 5 to the conductor cross-sectional area size of the insulated wire 2 is 1:3 . More specifically, the offset angle α between the distance R from the cable center to the center of the return wire to the return wire is varied, the value of the loop inductance L is indicated on the vertical axis, and the separation distance (distance R/reference value) is indicated on the horizontal axis with the original point set to 1. Then, the simulation values of the value of the loop inductance L are plotted on the graph in units of the inclination angle (α=0°, 5°, 10°, 20°). Here, in the case where the ratio of the conductor cross-sectional area size of the return wire 5 to the conductor cross-sectional area size of the insulated wire 2 is 1:3 , and the "distance R/reference value" ratio is less than or equal to 1.35, the low inductance return wire-contained unshielded cable 1A of the first embodiment of the present invention can easily be realized without increasing the outside diameter of the actual drive cable. Further, as the value of the loop inductance L necessary for the HF leakage current return wire, 0.4 μH/m or less has to be attained. However, as shown in FIG. 6, in the actual verification, as the ratios of the distances R from the centers of the respective insulated wires 2 to the reference value, the preferable results are indicated within the range of from 1 to 1.35.

Then, the inclination angle (α) of the return wire 5 will be discussed hereinafter. The low inductance return wire-contained unshielded cable 1A of the first embodiment of the present invention can easily be realized in a case as shown in FIG. 1(B). The case is that the position of a reference arrangement line, which is indicative of an arrangement angle, from the center O of the three insulated wires 2 is set to 120°. More specifically, the case is that, in the case where the return wire 5 not jacketed with the insulator is arranged in contact with the outer circumferential surface of the insulator 4 of any one of the adjacent insulated wires 2 in neighborhoods thereof, a line connecting between the cable center O and the center of the return wire 5 is set as a reference arrangement line. In this case, in the case where a range of offset angles $\alpha$ in the plus (+) and minus (−) directions are caused to be less than or equal to ±5° from the reference arrangement line, the low inductance return wire-contained unshielded cable 1A of the first embodiment can easily be realized. As shown in FIG. 6, the range of the offset angles $\alpha$ from the reference arrangement line position of 120° is indicated to be less than or equal to ±5° as preferable results.

From the above-described verification results, it can be known that, in the case of the low inductance return wire-contained unshielded cable 1A, the position and the inclination angle of the respective return wire 5 is requirements for realizing a preferable low inductance return wire-contained unshielded cable low inductance return wire-contained unshielded cable. More specifically, the requirements are that, as the arrangement position of the return wire 5, the distance R from the center O of the three insulated wires 2 is in the range of from 1 to 1.35 with respect to the reference value set to the distance in the case that the respective return wire 5 is arranged adjacent to and in closest contact with the motor drive insulated wire 2 in the neighborhood thereof and in the clearance (valley portion) between the insulated wires 2. Further, as the inclination angle of the respective return wire 5, in the case where, the position of a reference arrangement line, which is indicative of an arrangement angle, from the center O of the three insulated wires 2 is set to 120°, the range of the offset angles $\alpha$ from the reference arrangement line is less than or equal to ±5°.

Figure 2:
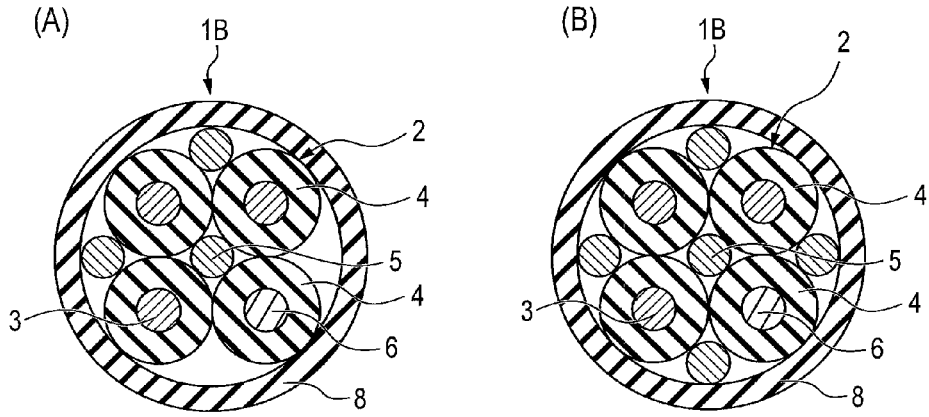
FIG. 2 shows cross sectional views showing the structures of HF leakage current return wire-contained motor drive cables of a second embodiment of the present invention.

FIG. 2(A) shows a second embodiment of the present invention, and the embodiment is a low inductance return wire-contained unshielded cable structure 1B configured as follows. In order to reduce the loop inductance L, three motor drive insulated wires 2 each jacketed with an insulator 4 and three HF leakage current return wires 5 not each provided with an insulative sheath are arranged in the manner that the three return wires 5 are arranged in contact with the outer circumferential surface of the insulator 4 of any one of the adjacent insulated wires 2 in the neighborhood thereof. Thereby, the loop inductance L of a loop circuit configured of the return wires is reduced, the ground wire jacketed with the insulator is added thereto, and the wires are arranged substantially parallel to the longitudinal direction and are stranded, and a sheath 8 is provided outside of the strand wires without a shield being included. As typical examples of the three insulated wires 2 each jacketed with the insulator 4 and the ground wire 6, a strand wire conductor is used for the conductor, and PVC is used for the insulator. Thus, as the insulator 4 for each of the three motor drive insulated wires 2 and the ground wire 6, which are each jacketed with the insulator 4, PTFE may be used as a low dielectric constant insulator. Thereby, the capacitance can be further reduced to reduce the drive power loss.

In the second embodiment shown in FIG. 2(A), the three HF leakage current return wires 5 not each provided with the insulative sheath are arranged on the circumference of one insulated wire (insulated wire diagonally arranged with respect to the ground wire 6) of the three motor drive insulated wires 2 each jacketed with the insulator 4 to be adjacent to and in close contact with the motor drive insulated wire 2 in neighborhoods thereof. In this case, the loop inductance L as a level in the case of the return wire 5 for one insulated wire is lower than those of the other two insulated wires. Hence, as shown in FIG. 2(B), the cable preferably is configured in the manner that the same number of return wires 5 are in close contact with the respective insulated wire.

Figure 3:
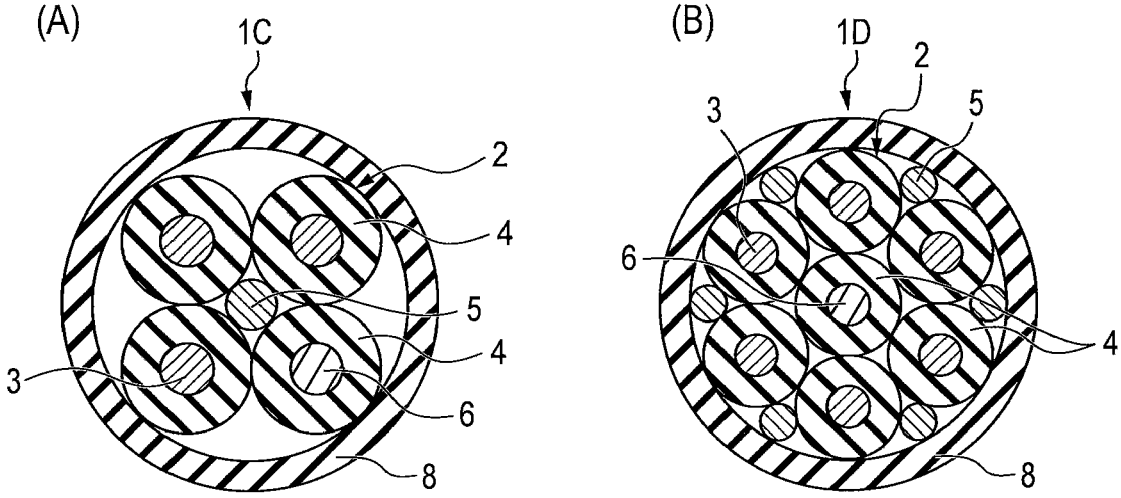
FIG. 3 shows cross sectional views showing the structures of HF leakage current return wire-contained motor drive cables of third and fourth embodiments of the present invention.

Further, as a modified example of the second embodiment of the present invention, a low inductance return wire-contained unshielded cable 10 is shown in FIG. 3(A). As shown in FIG. 3(A), the low inductance return wire-contained unshielded cable 1C is configured in the manner that, in the arrangement of the return wire 5 of the second embodiment (FIG. 2(A), 2(B)), one return wire 5 is arranged in the cable center.

FIG. 3(B) shows a fourth embodiment of the present invention, and the embodiment is a cable structure 1D configured in the manner that the number of insulated wires 2 is increased to six, and the ground wire 6 is arranged in the center thereof. The configuration thus formed makes it possible to realize a low inductance return wire-contained unshielded cable corresponding to a cable configuration in which multiple drive insulated wires are arranged. In the embodiment shown in FIG. 3(B), while the ground wire 6 is arranged in the cable center. However, the configuration may be such that the return wire 5 is arranged instead of the ground wire 6, although alternative configuration is not specifically described herein.

Figure 4:
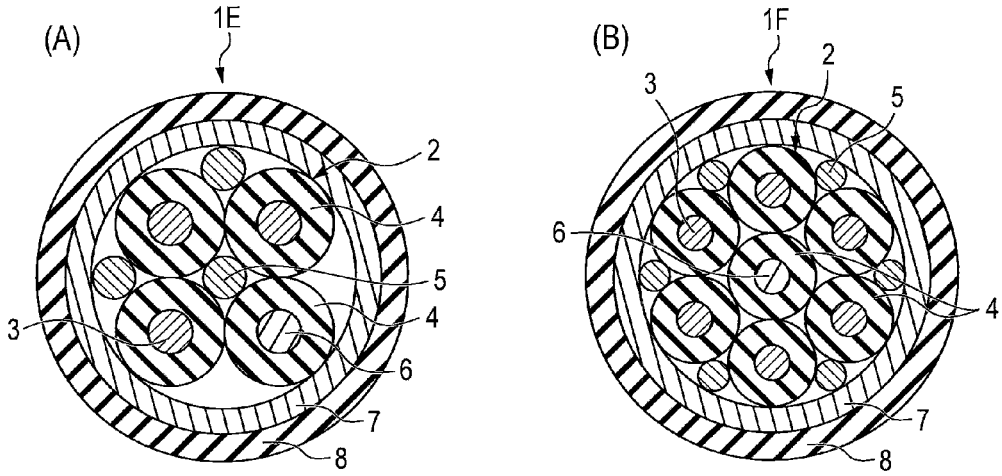
FIG. 4 shows cross sectional views showing the structures of HF leakage current return wire-contained motor drive cables of fifth and sixth embodiments of the present invention.

In regard to the basic construction, the present invention relates to the low inductance return wire-contained unshielded cable structure including the sheath provided without a shield provided outside of the strand wire. However, it should be apparent that, if the shield is provided, the loop inductance L can be reduced, and also a shield effect can be expected. Hence, in this configuration, the terminal workability is somewhat reduced since the shield shown in, for example, FIG. 4(A) or 4(B), is provided in addition to the forming of the basic construction of the present invention. However, by providing a shield material in addition to the employment of the low inductance return wires according to the basic technical idea of the present invention, further grade enhancement is accomplished, and the noise recovery percentage is further increased. Further, the material may be an ordinary low dielectric constant insulator; and various modifications are, of course, included for designing within the scope of the present invention.

FIG. 4(A) shows a fifth embodiment of the present invention, and the embodiment is a cable structure 1E formed in the manner that a shield 7 is provided inside of the sheath 8 of the second embodiment (FIG. 2(A)). This makes it possible not only to obtain the effect of the present invention that enables the HF leakage current to be returned by the return wires 5 to the inverter side from the motor side, but also to obtain the shield effect. FIG. 4(B) shows a sixth embodiment of the present invention, and the embodiment is a cable structure 1F configured in the manner that the number of insulated wires 2 is increased to six, and the shield 7 is provided on the outer circumference of the cable including the ground wire 6 arranged in the center thereof. Similar to the cable structure shown in FIG. 4(A), this cable structure makes it possible not only to obtain the effect of the present invention that enables the HF leakage current to be returned by the return wires 5 to the inverter side from the motor side, but also to obtain the shield effect.

Figure 7:
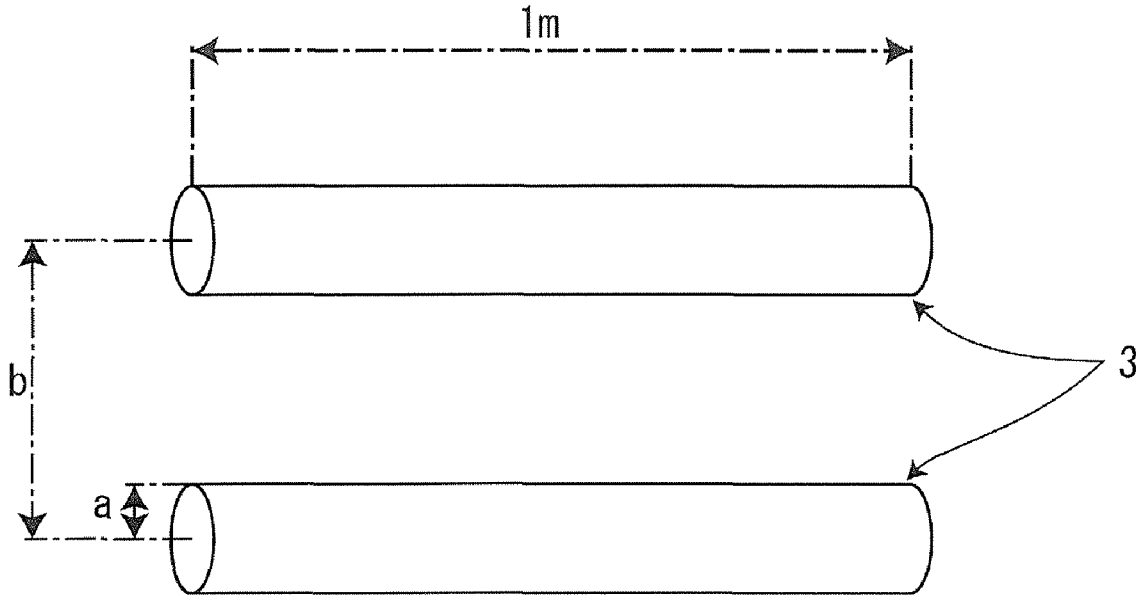
FIG. 7 is an explanative simplified diagram showing effects and advantages of the present invention.

Next, theoretic-computational approximation expressions for explaining reasons that the loop inductance is reduced. For purposes of brevity, the loop inductance on the basis of two parallel wires as shown in FIG. 7 is considered. The approximation expressions are generally known, and are described in publications, such as "Wire Telephone Transmission Engineering—Transmission Line Theory" (Hayashi Kenichi, Gakken, Jan. 31, 1969).

Where L: loop inductance on the basis of unit length; $\mu_0$: magnetic permeability; $\pi$: circular constant; $\log_e$: natural logarithm; b: inter-conductor distance; a: conductor radius; $\in$: dielectric constant; and C: capacitance per unit length, expressions (1) and (2) are established.

$$L=(\mu_0/\pi)\cdot(\log_e(b/a)+(1/4)) \quad (1)$$

$$C=\pi\cdot\in\cdot(1/(\log_e(b/a))) \quad (2)$$

According to expression (1), the loop inductance L is reduced when the conductor radius a increases, and the loop inductance L is reduced when the inter-conductor distance b reduces. In the present invention, the reduction of the loop inductance L is implemented by the reduction of the inter-conductor distance b.

Figure 8:
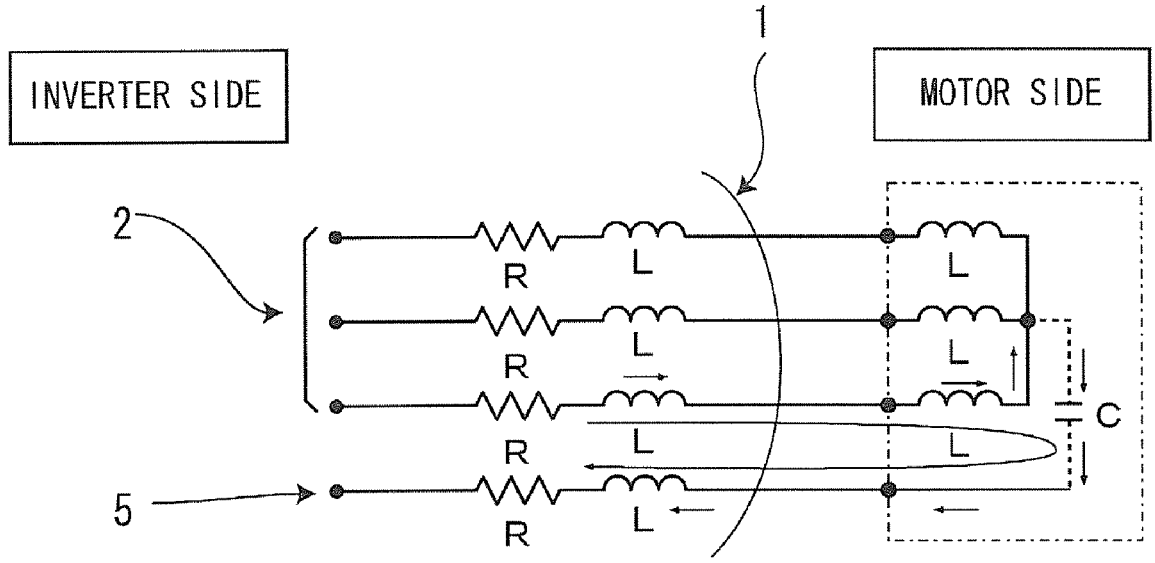
FIG. 8 is an explanatory view of an equivalent circuit showing operation of a HF leakage current return wire-contained motor drive cable according to the present invention.

FIG. 8 is an explanatory view of an equivalent circuit related to a HF leakage current return wire-contained three-phase motor drive cable 1 according to the present invention, in which the cable connects between the inverter side and the motor side. In FIG. 8, only one HF leakage current return wire 5 is shown for purposes of brevity. However, it should be apparent from the above descriptions that the return wires 5 are arranged to the respective three motor drive insulated wires 2. Clearly from the drawing, the impedance of the current flowing through two parallel wires is reduced by the reduction of the loop inductance L (only one return loop is shown by an arrow). Hence, the HF leakage current can be efficiently flowed as return current from the motor side to the inverter side. In FIG. 8, C represents a stray capacitance of the motor side.

In accordance with expression (1), the loop inductance L is reduced when the conductor radius a increases or when inter-conductor distance b reduces. The present invention includes a new configuration discovered as a method that reduces the loop inductance L by reducing the inter-conductor distance b. However, the capacitance C is increased concurrently with the reduction of the loop inductance L, so that a leakage current associated with the capacitance C. While so much influence is not imposed when the driving pulse width is large and the frequency is low, the capacitance C causes an increase of the driving power to blunt the pulse driving the motor when the driving pulse width is small and the frequency is high. Hence, by reducing the dielectric constant of the insulative material and the increase of the driving power can be inhibited.

Figure 9:
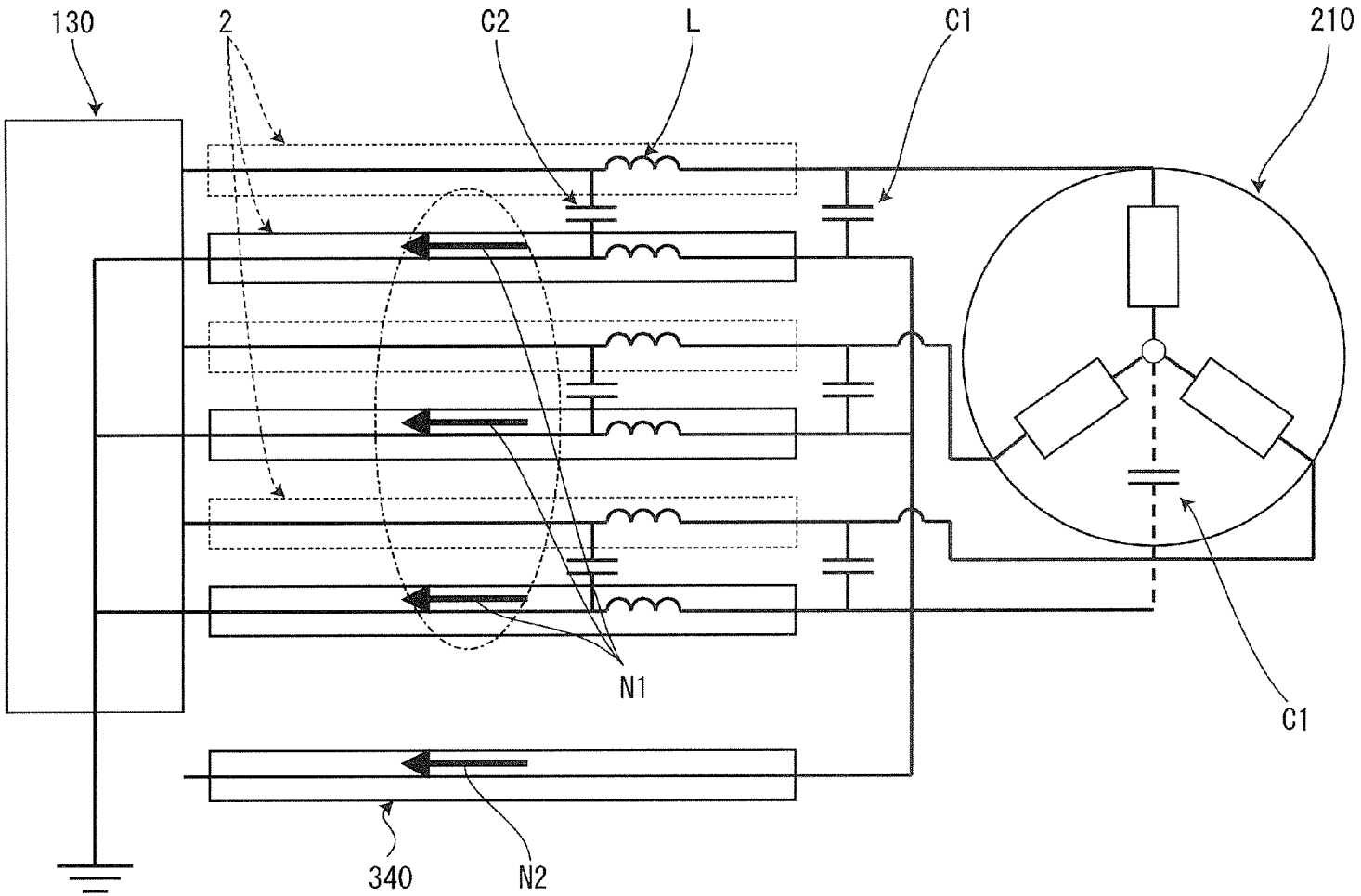
FIG. 9 is an explanatory view of the principle of effects of the present invention.

Next, FIG. 9 is an explanatory view of the principle of effects of a low inductance return wire-contained unshielded cable 1 according to the present embodiment. In FIG. 9, an inverter 130 on the side of a driving control device and a motor 210 on the side of a driven device are interconnected by the three insulated wires 2. Further in FIG. 9, the inductance of each of the respective insulated wire 2 and the return wire 5 is shown by L, the capacitor between therebetween is shown by C2, and the stray capacitance between the respective motor drive insulated wire 2 and the respective return wire 5 is shown by C1. In the structure, while the distance relation is unclear from FIG. 9, the distance between the conductor of the insulated wire 2 and the return wire 5 are reduced as much as possible to reduce the loop inductance, the three wires are stranded into a symmetric structure, and the occurrence of noise is reduced. Further, ordinarily, a cable 340 for signal communication with a peripheral device such as an encoder is provided between the side of the driving control device and the side of the driven device.

In the system configuration, the HF leakage current is returned by the drive cable itself to inhibit HF noise from riding on the encoder signal. In order to achieve this, the impedance of the return wire routed through the return wire 5 has to be reduced. In order to reduce the return-wire impedance, either C can be increased or L can be reduced according to the expression $\sqrt{(L/C)}$. However, when C is increased, the waveform distortion is increased, so that, preferably, L is reduced. More specifically, it is necessary to the loop inductance L of the return wire routed through the return wire 5 has to be caused to be low. It is further necessary to prevent that a potential difference occurs with the return wire to overlap with a shield of the encoder cable 340. Thus, the impedance of the current flowing through the two parallel wires is reduced in association with through the reduction of the loop inductance L of the return wire. Hence, the HF leakage current can be effectively flowed to the side of the inverter.

FIG. 10 is a table of "comparison results (noise currents) of evaluation examinations of the respective embodiments of the present invention and conventional examples". First of all, evaluations were performed for types of samples listed below. Comparison studies were carried out for measured noise currents and simulation computations of the noise currents and inductances of the following eight types: 1. conventional unshielded second type cable No. 1 (FIG. 15(B)) containing four wires (three insulated wires and one ground wire); 2. conventional shielded third type cable No. 2 (FIG. 15(C)) containing four wires (three insulated wires and one ground wire); 3. conventional shielded third type cable No. 2 (FIG. 15(C)) containing four wires (three insulated wires and one ground wire) (not shown since it is identical to that shown in FIG. 15(C)); 4. first embodiment (FIG. 1(A)) containing the three insulated wires according to the present invention; 5. second embodiment (FIG. 2(A)) of the unshielded cable containing four wires (three insulated wires and one ground wire) according to the present invention; 6. third embodiment (FIG. 3(A) according to the present invention; 7. first embodiment No. 1 (FIG. 1(C): in the case where the cross-sectional area size of the return wire is 1:3) containing the three insulated wires according to the present invention; 8. first embodiment No. 2 containing the three insulated wires according to the present invention.

As is apparent from the table of FIG. 10, the results in order of excellent results were as described hereinafter. (1) In the case of the first embodiment (FIG. 1(A)) containing the three insulated wires according to the present invention, the noise current was 0.40 A, and the loop inductance L as the return wire was 0.302 μH/m. (2) In the case of the second embodiment (FIG. 2(A)) according to the present invention, the noise current was 0.45 A, and the loop inductance L of the cable as the return wire was 0.306 μH/m. (3) In the case of the third embodiment (FIG. 3(A)) according to the present invention, the noise current was 0.50 A, and the loop inductance L of the cable as the return wire was 0.310 μH/m. (4) In the case of the modified example of the first embodiment (FIG. 1(C)) according to the present invention, the noise current was 0.50 A at maximum, and the loop inductance L of the cable as a level in the case of the return wire was 0.310 μH/m. As the effects of any of those embodiments, there are shown better results than those of the conventional unshielded second type cable (noise current: 0.90 A; loop inductance L: 0.804 μH/m). In the cases of the conventional shielded third type cable No. 1 (noise current: 0.50 A; loop inductance L: 0.310 μH/m) and the conventional shielded third type cable No. 2 (noise current: 0.70 A; loop inductance L: 0.400 μH/m), there occurred a noise current variation, and a loop inductance variation occurred, and a loop inductance fluctuation associated with a structural fluctuation occurred. Hence, a simulation incorporating the consideration of a positional variation was performed for the first embodiment (FIG. 1(C): in the case where the cross-sectional area size of the return wire is 1:3 ) containing the three insulated wires according to the present invention. According to the results, the ratio of the distance R from the center was 1.35, and the loop inductance in the case where the sway angle is ±0.5° is 0.398 μH/m, so that there are no drawbacks even in comparison with the case where the return wires are arranged with a range of variations.

Among the above, in the case of the first embodiment (FIG. 1(A)) containing the three insulated wires according to the present invention, the best result was indicated, in which the noise current is 0.40 A, and the loop inductance L as a level in the case of the return wire is 0.302 μH/m. Further, in the case of the first embodiment according to the present invention, equivalent or better results were indicated in comparison with the conventional shielded third type cable (noise current: 0.50 A; loop inductance L: 0.310 μH/m).

The present invention exemplifies typical three-phase motor drive cable structures and low inductance return wire-contained unshielded cable structures. However, the reduction of the loop inductance L may be implemented in the manner that, for example, a larger number of leakage current return wires are arranged, or the motor drive insulated wire is divided. Further, in order to obtain the shield effect, a shield material may be used in addition to employ the low inductance return wire according to the basic technical idea, although the terminal workability is reduced. Further, in order to inhibit an increase of the capacitance, it is even more preferable that the material of the insulator is an ordinary low dielectric constant insulative material; and various modifications are, of course, included for designing within the scope of the present invention.

While the motor drive cable according to the present invention can be used for a numerically controlled machine tool, it can also be applied and deployed in a wide range to, for example, a robot or injection molding machine that uses. Application and deployment of the present invention will be described hereinafter bearing in mind a numerically controlled machine tool system using the cable.

Ordinarily, in a numerically controlled machine tool, motors to be used for a cutting process and the like, in which the motors are driven by an inverter. In this event, as a matter of course, the inverter on the side of a control device and the motor on the side of a driven device are interconnected by a drive cable. Further, an encoder is arranged in the respective motor, and the rotation angle of the respective motor is controlled by a numerically controlled device while the output from the encoder is being detected. Conceptual views thereof are shown in FIGS. 11 and 12.

Figure 11:
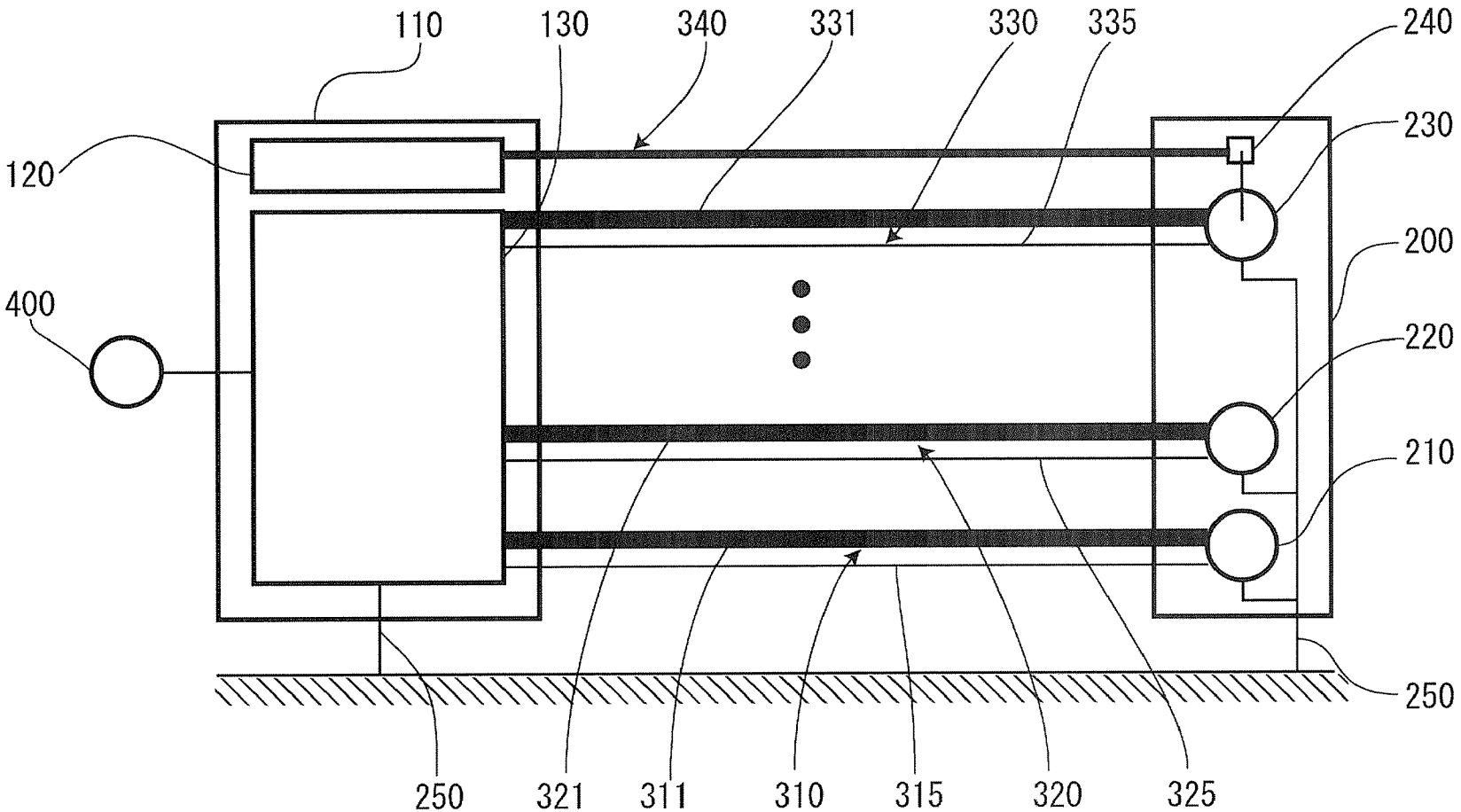
FIG. 11 is a system diagram of a numerically controlled machine tool using a conventional drive cable.

FIG. 11 shows a numerically controlled machine tool system in the case where a conventional drive cable is used. A numerically controlled machine tool 200 includes motors 210, 220, and 230 corresponding to respective process axes (portions corresponding to only three process axes are shown). The respective motors 210, 220, and 230 are connected to a motor drive inverter 130 provided in an electronic cabinet 110 through drive cables 310, 320, and 330. A numeric control device 120 is provided in the electronic cabinet 110 to control NC control. In the numerically controlled machine tool 200, encoders 240 are provided (although the encoders are mounted to the respective motors, only the encoder provided to only the motor 230 is shown for simplifying the drawing). The encoder 240 is connected to the numeric control device 120 through an information transmission cable 340 (ordinarily, a shielded cable). The drive cables 310, 320, and 330, respectively, include power cables 311, 321, and 331 and ground wires 315, 325, and 335. The respective motors 210, 220, and 230 of the numerically controlled machine tool 200 and the motor drive inverter 130 in the electronic cabinet 110 are grounded through an enclosure ground 250 for purposes of security. However, in the conventional example, since a HF loop inductance of the ground wire with respect to the power cable is high, the noise current flows to the ground through the enclosure ground 250. Further, since the respective motors 210, 220, 230, and the encoders 240 are commonly grounded to the enclosure ground 250, the HF leakage current flows to the encoders 240. Hence, the current resultantly leaks to the numeric control device 120 through the information transmission cable 340, thereby being the cause of malfunction.

Figure 12:
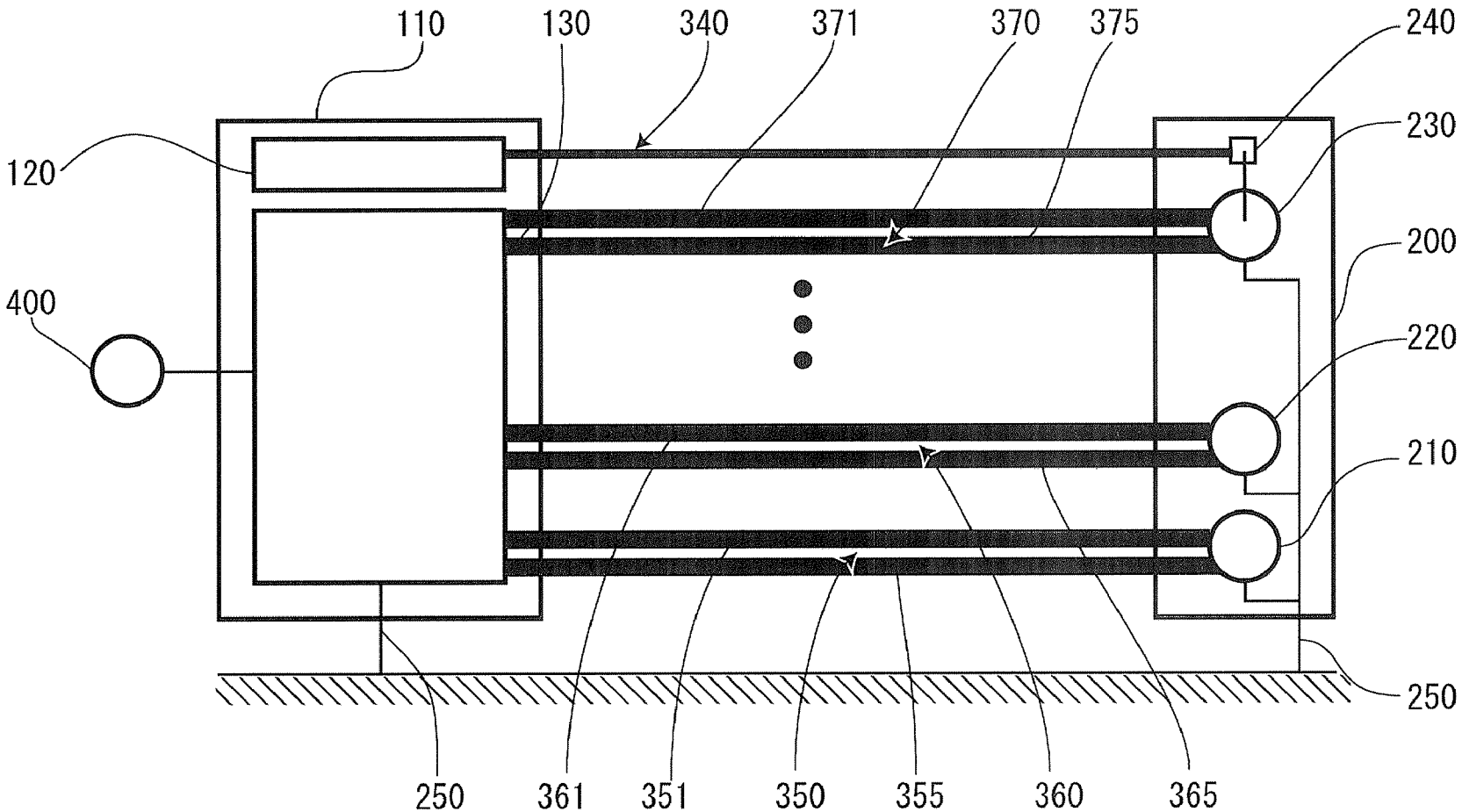
FIG. 12 is a system diagram of a numerically controlled machine tool using a HF leakage current return wire-contained three-phase motor drive cable according to the present invention.

In comparison, FIG. 12 shows a numerically controlled machine tool system using the high frequency leakage current return wire-contained motor drive cable according to the present invention. The same reference numerals are used to represent the components not different from those in the conventional system shown in FIG. 11. The numerically controlled machine tool 200 includes motors 210, 220, and 230 corresponding to respective process axes (portions corresponding to only three process axes are shown). The respective motors 210, 220, and 230 are connected to a motor drive inverter 130 provided in an electronic cabinet 110 through drive cables 350, 360, and 370. A numeric control device 120 is provided in the electronic cabinet 110 to control NC control. In the numerically controlled machine tool 200, encoders 240 are provided (although the encoders are mounted to the respective motors, only the encoder provided to only the motor 230 is shown for simplifying the drawing). The encoder 240 is connected to the numeric control device 120 through the information transmission cable 340 (ordinarily, a shielded cable). The drive cables 350, 360, and 370, respectively, include power cables 351, 361, and 371 and HF leakage current return wires 355, 365, and 375. Similarly as in the conventional example, the respective motors 210, 220, and 230 of the numerically controlled machine tool 200 and the motor drive inverter 130 in the electronic cabinet 110 are grounded through an enclosure ground 250 for purposes of security. As already described above, the drive cables used in the system according to the present invention are characterized in that the HF leakage current return wires 355, 365, and 375, respectively, are arranged adjacent to and in close contact with the power cables 351, 361, and 371. Hence, the loop inductances are reduced, the HF leakage current is thereby caused to easily flow through the HF leakage current return wires 355, 365, and 375, and the HF leakage current flowing to peripheral devices, such as the encoders, through the enclosure ground 250 and the like is reduced.

Figure 13:
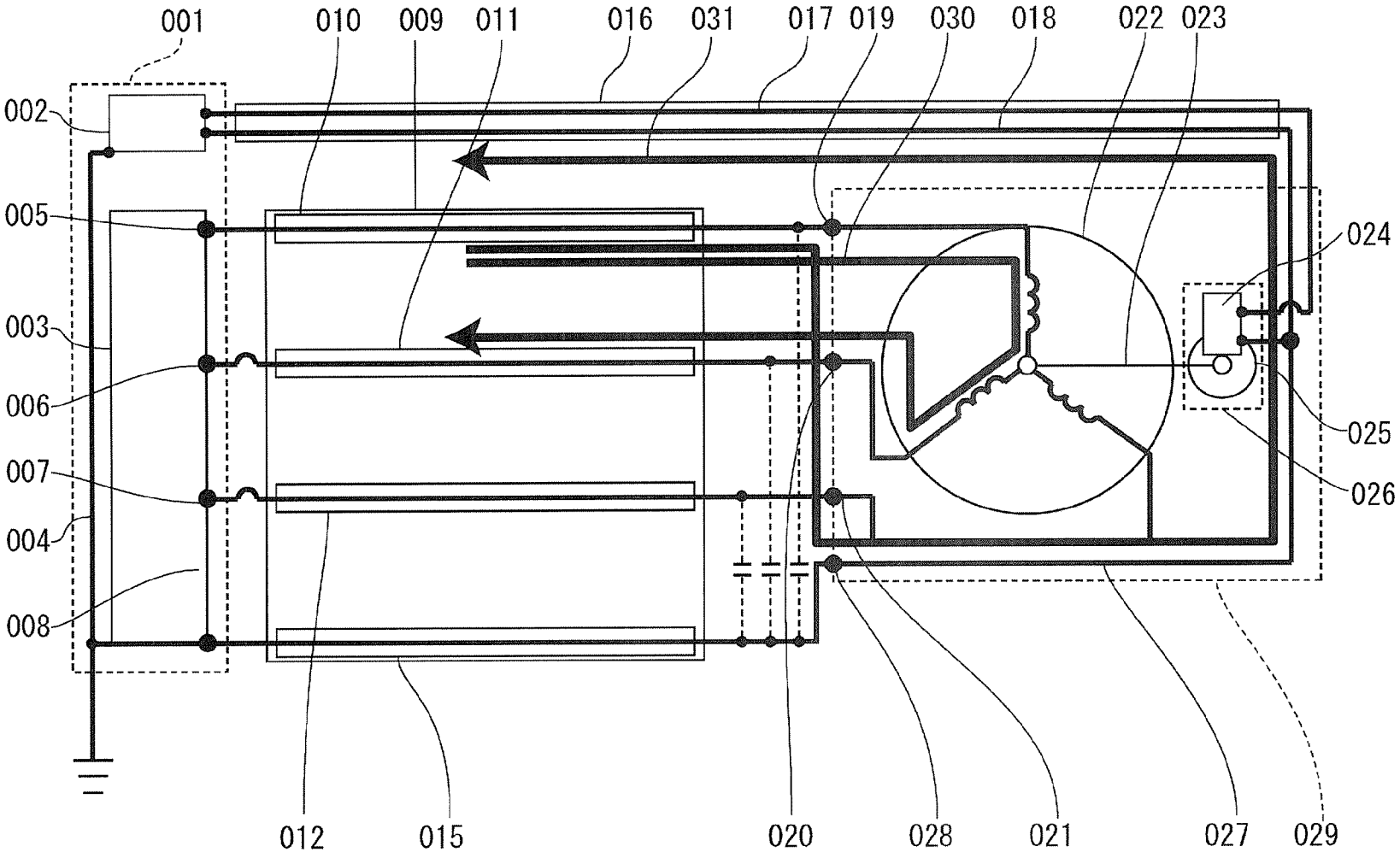
FIG. 13 is a detail view of a cable wiring arrangement corresponding to one axis of the numerically controlled machine tool using the conventional drive cable is used.

Further, a more detailed description will be provided hereinafter with reference to drawings each showing an extracted portion of only one motor. FIG. 13 is a detail view of a cable wiring arrangement corresponding to one process axis of the numerically controlled machine using the conventional drive cable.

In FIG. 13, the reference numerals represent as follows: 001 represents an electronic cabinet, 002 represents a numeric control device, 003 represents a motor drive inverter, 004 represents an electronic cabinet ground wire, 005 represents a motor drive inverter U-phase terminal, 006 represents a motor drive inverter V-phase terminal, 007 represents a motor drive inverter W-phase terminal, 008 represents a motor drive inverter neutral node terminal, 009 represents a motor drive cable, 010 represents a motor drive cable power cable, 011 represents a motor drive cable power cable, 012 represents a motor drive cable power cable, 015 represents a motor drive cable ground wire, 016 represents an information transmission cable, 017 information transmission cable signal wire, 018 represents an information transmission cable ground wire (shielded), 019 represents a motor U-phase terminal, 020 represents a motor V-phase terminal, 021 represents a motor W-phase terminal, 022 represents a motor body, 023 represents a motor shaft, 024 represents an encoder, 025 represents an encoder disc, 026 represents an encoder unit, 027 represents a motor ground wire, 028 represents motor ground wire terminal, 029 represents a motor unit, 030 represents a motor drive current (flow), and 031 represents a HF leakage current (flow).

In the conventional drive control system shown in FIG. 13, in association of the flow of a motor drive current 030, since the inductance of the motor drive cable ground wire is great, an occurred noise current 031 flows towards a portion having a small inductance. As shown in the drawing, the ground wire (shielded) of the information transmission cable used for the encoder is present as a route of the current flow, the noise propagates to, for example, the information transmission cable signal wire to the extent of causing error.

Figure 14:
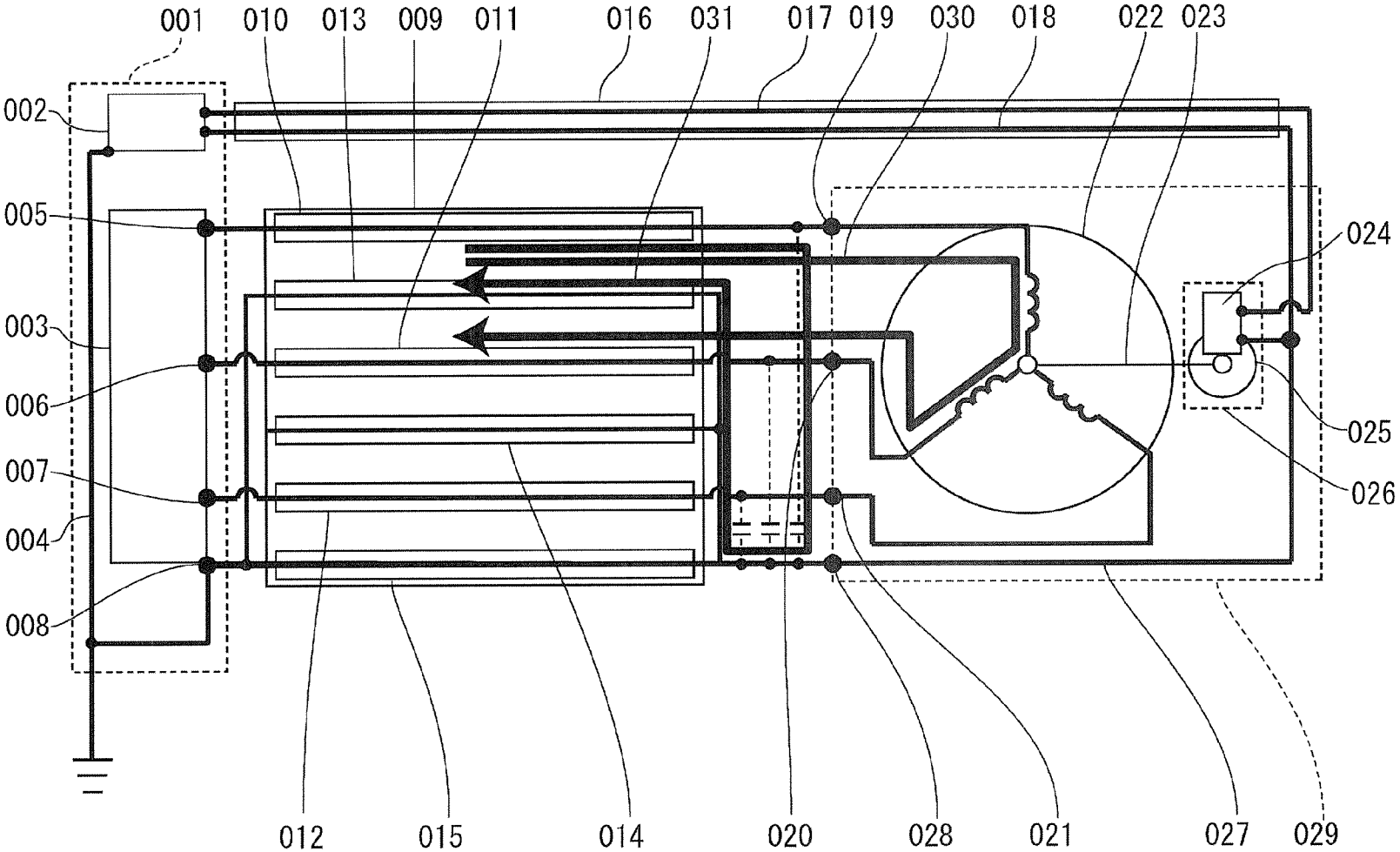
FIG. 14 is a detail view of a cable wiring arrangement corresponding to one axis of the numerically controlled machine tool using the HF leakage current return wire-contained motor drive cable according to the present invention.

FIG. 14 is a detail view of a cable wiring arrangement corresponding to one process axis of the numerically controlled machine using the HF leakage current return wire-contained motor drive cable according to the present invention.

In FIG. 14, the reference numerals represent as follows: 001 represents an electronic cabinet, 002 represents a numeric control device, 003 represents a motor drive inverter, 004 represents an electronic cabinet ground wire, 005 represents a motor drive inverter U-phase terminal, 006 represents a motor drive inverter V-phase terminal, 007 represents a motor drive inverter W-phase terminal, 008 represents motor drive inverter neutral node terminal, 009 represents a motor drive cable, 010 represents a motor drive cable power cable, 011 represents a motor drive cable power cable, 012 represents a motor drive cable power cable, 013 represents a HF leakage current return wire, 014 represents a HF leakage current return wire, 015 represents a HF leakage current return wire, 016 represents an information transmission cable, 017 information transmission cable signal wire, 018 represents an information transmission cable ground wire (shielded), 019 represents a motor U-phase terminal, 020 represents a motor V-phase terminal, 021 represents a motor W-phase terminal, 022 represents a motor body, 023 represents a motor shaft, 024 represents an encoder, 025 represents an encoder disc, 026 represents an encoder unit, 027 represents a motor ground wire, 028 represents a motor ground wire terminal, 029 represents a motor unit, 030 represents a motor drive current (flow), and 031 represents a HF leakage current (flow).

In the control system of the present invention shown in FIG. 14, in association of the flow of a motor drive current 030, since the inductance of the motor drive cable ground wire is great, an occurred noise current 031 flows towards a portion having a small loop inductance. Hence, as shown in the drawing, the current is less likely to flow to the side of the encoder or the side of the ground, therefore making it possible to prevent the noise from propagating to, for example, the information transmission cable signal wire to the extent of causing error.

The invention claimed is:

1. A high frequency (HF) leakage current return wire-contained motor drive cable comprising:

a plurality of drive insulated wires;

at least one HF leakage current return wire, the plurality of drive insulated wires and the at least one HF leakage current return wire being arranged adjacent to and in close contact to thereby reduce inductances of the at least one HF leakage current return wire and substantially parallel to a longitudinal direction and being stranded; and a sheath provided on the outer circumference of the stranded wires without a shield being provided outside of the strand wires.

2. The HF leakage current return wire-contained motor drive cable as defined in claim 1, characterized in that the at least one HF leakage current return wire are each configured from only a conductor not insulated.

3. A numerically controlled machine tool, robot, or injection molding machine, characterized by using, as a power cable for a motor, the HF leakage current return wire-contained motor drive cable as defined in claim 2.

4. The HF leakage current return wire-contained motor drive cable as defined in claim 1, characterized in that the at least one HF leakage current return wire are each configured from a conductor jacketed with an ordinarily insulator or a low dielectric constant insulator around the conductor.

5. A numerically controlled machine tool, robot, or injection molding machine, characterized by using, as a power cable for a motor, the HF leakage current return wire-contained motor drive cable as defined in claim 4.

6. The HF leakage current return wire-contained motor drive cable as defined in claim 1, characterized in that a low dielectric constant insulators is as an insulator of the drive insulated wire and the ground wire.

7. A numerically controlled machine tool, robot, or injection molding machine, characterized by using, as a power cable for a motor, the HF leakage current return wire-contained motor drive cable as defined in claim 6.

8. A numerically controlled machine tool, robot, or injection molding machine, characterized by using, as a power cable for a motor, the HF leakage current return wire-contained motor drive cable as defined in claim 1.

9. A high frequency (HF) leakage current return wire-contained motor drive cable comprising:

a plurality of drive insulated wires;

a ground wire;

at least one HF leakage current return wire, the plurality of drive insulated wires and the at least one HF leakage current return wire being arranged adjacent to and in close contact to thereby reduce inductances of the at least one HF leakage current return wire, and the drive insulated wires, the at least one HF leakage current return wire, and the ground wire being arranged substantially parallel to a longitudinal direction and being stranded; and a sheath provided on the outer circumference of the stranded wires without a shield being provided outside of the strand wires.

10. The HF leakage current return wire-contained motor drive cable as defined in claim 2, characterized in that each of the at least one HF leakage current return wires is configured from only a conductor not insulated.

11. A numerically controlled machine tool, robot, or injection molding machine, characterized by using, as a power cable for a motor, the HF leakage current return wire-contained motor drive cable as defined in claim 10.

12. The HF leakage current return wire-contained motor drive cable as defined in claim 9, characterized in that the at least one HF leakage current return wire are each configured from a conductor jacketed with an ordinarily insulator or a low dielectric constant insulator around the conductor.

13. A numerically controlled machine tool, robot, or injection molding machine, characterized by using, as a power cable for a motor, the HF leakage current return wire-contained motor drive cable as defined in claim 12.

14. The HF leakage current return wire-contained motor drive cable as defined in claim 9, characterized in that a low dielectric constant insulators is as an insulator of the drive insulated wire and the ground wire.

15. A numerically controlled machine tool, robot, or injection molding machine, characterized by using, as a power cable for a motor, the HF leakage current return wire-contained motor drive cable as defined in claim 14.

16. A numerically controlled machine tool, robot, or injection molding machine, characterized by using, as a power cable for a motor, the HF leakage current return wire-contained motor drive cable as defined in claim 9.

17. A high frequency (HF) leakage current return wire-contained motor drive cable comprising:

a plurality of drive insulated wires;

at least one HF leakage current return wire, the plurality of drive insulated wires and the at least one HF leakage current return wire being arranged adjacent to and in close contact to thereby reduce inductances of the at least one HF leakage current return wire and substantially parallel to a longitudinal direction and are stranded;

a shield provided outside of the strand wires; and a sheath provided outside of the shield.

18. A numerically controlled machine tool, robot, or injection molding machine, characterized by using, as a power cable for a motor, the HF leakage current return wire-contained motor drive cable as defined in claim 17.

19. A high frequency (HF) leakage current return wire-contained motor drive cable comprising:

a plurality of drive insulated wires;

a ground wire;

at least one HF leakage current return wire, the plurality of drive insulated wires and the at least one HF leakage current return wire being arranged adjacent to and in close contact to thereby reduce inductances of the at least one HF leakage current return wire, and the drive insulated wires, the at least one HF leakage current return wire, and the ground wire being arranged substantially parallel to a longitudinal direction and being stranded;

a shield provided outside of the strand wires; and a sheath provided outside of the shield.

20. A numerically controlled machine tool, robot, or injection molding machine, characterized by using, as a power cable for a motor, the HF leakage current return wire-contained motor drive cable as defined in claim 19.

21. A low inductance return wire-contained unshielded cable comprising, as viewed from a cable cross-sectional direction:

three insulated wires respectively arranged independently at three apexes of a substantially equilateral triangle;

three return wires respectively arranged in external portions of valley portions of an assembly formed from the three insulated wires at three apexes of a substantially equilateral triangle to be adjacent to and in close contact with the insulated wires, thereby to reduce inductances of loop circuits configured from the respective insulated wires and return wires, the three insulated wires and the three return wires being arranged substantially parallel to a longitudinal direction and stranded along the same direction; and a sheath being provided on the outer circumference of the stranded wires without a shield being provided outside of the strand wires.

22. A numerically controlled machine tool, robot, or injection molding machine, characterized by using, as a power cable for a motor, the low inductance return wire-contained unshielded cable as defined in claim 21.

23. A low inductance return wire-contained unshielded cable comprising:

three insulated wires;

one ground wire;

one or more return wires arranged adjacent to and in close contact with an outer circumference of any one of the three insulated wires to thereby reduce inductances of loop circuit configured from the insulated wires and the return wires, the three drive insulated wires, the one or more of return wires, and the one ground wire being arranged substantially parallel to a longitudinal direction and being stranded; and a sheath provided on the outer circumference of the stranded wires without a shield being provided outside of the strand wires.

24. A numerically controlled machine tool, robot, or injection molding machine, characterized by using, as a power cable for a motor, the low inductance return wire-contained unshielded cable as defined in claim 23.

25. A low inductance return wire-contained unshielded cable comprising, as viewed from a cable cross-sectional direction:

three insulated wires respectively arranged independently at three apexes of a substantially equilateral triangle; and a return wire not provided with an insulative sheath arranged in a central portion of the three insulated wires, thereby to reduce inductances of loop circuits configured from the insulated wires and return wires.

26. A numerically controlled machine tool, robot, or injection molding machine, characterized by using, as a power cable for a motor, the low inductance return wire-contained unshielded cable as defined in claim 25.

27. A high frequency (HF) leakage current return wire-contained drive cable for interconnecting an inverter and a driven control device comprising:

a plurality of drive insulated wires;

one or more HF leakage current return wires not each jacketed with an insulative sheath, the plurality of drive insulated wires and the one or more HF leakage current return wire being adjacently arranged substantially parallel to a longitudinal direction and being stranded; and a sheath provided on the outer circumference of the stranded wires without a shield being provided outside of the strand wires, wherein the inverter and the driven control device are interconnected by the drive cable to thereby reduce inductances of loop circuits configured from the respective insulated wires and return wires, thereby to form the HF leakage current return wire as a return path of the HF leakage current from the driven control device to the inverter.

28. The HF leakage current return wire-contained drive cable as defined in claim 27, further comprising one ground wire added to the plurality of drive insulated wires that are adjacently arranged substantially parallel to the longitudinal direction.

29. The HF leakage current return wire-contained drive cable as defined in claim 28, characterized in that the HF leakage current return wire is arranged adjacent to and in close contact with outer circumferences of sheaths of the respective drive insulated wires each provided with an insulative sheath in a manner that an increase in capacitance is inhibited with a wire formed by jacketing an outer circumference of a conductor with an insulator or low dielectric constant insulator.

30. A numerically controlled machine tool, robot, or injection molding machine, characterized by using, as a power cable for a motor, the HF leakage current return wire-contained drive cable as defined in claim 29.

31. A numerically controlled machine tool, robot, or injection molding machine, characterized by using, as a power cable for a motor, the HF leakage current return wire-contained drive cable as defined in claim 28.

32. The HF leakage current return wire-contained drive cable as defined in claim 27, characterized in that the HF leakage current return wire is arranged adjacent to and in close contact with outer circumferences of sheaths of the respective drive insulated wires each provided with an insulative sheath in a manner that an increase in capacitance is inhibited with a wire formed by jacketing an outer circumference of a conductor with an insulator or low dielectric constant insulator.

33. A numerically controlled machine tool, robot, or injection molding machine, characterized by using, as a power cable for a motor, the HF leakage current return wire-contained drive cable as defined in claim 32.

34. A numerically controlled machine tool, robot, or injection molding machine, characterized by using, as a power cable for a motor, the HF leakage current return wire-contained drive cable as defined in claim 27.

35. A high frequency (HF) leakage current return wire-contained motor drive cable for interconnecting an inverter and a driven control device comprising, as viewed from a cable cross-sectional direction:

three insulated wires respectively arranged independently at three apexes of a substantially equilateral triangle;

three HF leakage current return wires respectively arranged at three apexes of a substantially equilateral triangle, the three HF leakage current return wires arranged to be adjacent to and in close contact with the insulated wires, and the wires thus arranged are stranded; and a sheath provided on the outer circumference of the stranded wires without a shield being provided outside of the strand wires, wherein the inverter and the driven control device are interconnected by the drive cable to thereby reduce inductances of loop circuits configured from the respective insulated wires and return wires, thereby to form the HF leakage current return wires as return paths of the HF leakage current from the driven control device to the inverter.

36. The HF leakage current return wire-contained drive cable as defined in claim 35, characterized in that a loop inductance L of the respective HF leakage current return wire configuring the loop circuit is caused to be less than or equal to 0.4 μH/m.

37. The HF leakage current return wire-contained motor drive cable configured from the three drive insulated wires and the three HF leakage current return wires arranged adjacent to and in close contact with the respective insulated wires, as defined in claim 36, the drive cable being, characterized in that, where a conductor cross-sectional area size of respective one of the three drive insulated wires is S, a conductor cross-sectional area size P of the respective current return wire is caused to fall within a range defined by expression (1):

$$P/3<S\leqq P \quad (1).$$

38. A numerically controlled machine tool, robot, or injection molding machine, characterized by using, as a power cable for a motor, the HF leakage current return wire-contained motor drive cable as defined in claim 37.

39. The HF leakage current return wire-contained motor drive cable configured from the three drive insulated wires and the three HF leakage current return wires arranged adjacent to and in close contact with the respective insulated wires as defined in claim 36, the drive cable being characterized in that, where a center of the triangle is O, a distance from the center O to a center of the respective HF leakage current return wire in the case where the respective HF leakage current return wire is arranged in contact with both of two adjacent drive insulated wires of the three drive insulated wires are r1, r2, and r3 (r1≈r2r3), and a closest distance is R, a largest distance (such as r1) having a largest value among the distances 1, r2, and r3 in the case where the respective HF leakage current return wires are actually arranged is caused to fall within expression (2):

$$R\leqq r1<1.35R \quad (2).$$

40. A numerically controlled machine tool, robot, or injection molding machine, characterized by using, as a power cable for a motor, the HF leakage current return wire-contained motor drive cable as defined in claim 39.

41. The HF leakage current return wire-contained motor drive cable configured from the three drive insulated wires and the three HF leakage current return wires arranged adjacent to and in close contact with the respective insulated wires, as defined in claim 36, the drive cable being characterized in that, where a straight line interconnecting the center 0 of the triangle to the center of the respective HF leakage current return wire in the case where the respective HF leakage current return wire is arranged in contact with both of two adjacent drive insulated wires of the three drive insulated wires is a reference line, a range of an offset angle a with respect to the reference line interconnecting the center O and the center of the respective HF leakage current return wire in the case where the respective HF leakage current return wires are actually arranged is caused to fall within expression (3):

$$-5°<\alpha<+5° \quad (3).$$

42. A numerically controlled machine tool, robot, or injection molding machine, characterized by using, as a power cable for a motor, the HF leakage current return wire-contained motor drive cable as defined in claim 41.

43. A numerically controlled machine tool, robot, or injection molding machine, characterized by using, as a power cable for a motor, the HF leakage current return wire-contained motor drive cable as defined in claim 36.

44. The HF leakage current return wire-contained drive cable as defined in claim 36, characterized in that the loop inductance L of the respective leakage current return wire configuring the loop circuit is caused to be less than or equal to 0.31 μH/m.

45. The HF leakage current return wire-contained motor drive cable configured from the three drive insulated wires and the three HF leakage current return wires arranged adjacent to and in close contact with the respective insulated wires, as defined in claim 35, the drive cable being characterized in that, where a conductor cross-sectional area size of respective one of the three drive insulated wires is S, a conductor cross-sectional area size P of the respective current return wire is caused to fall within a range defined by expression (1):

$$P/3<S\leqq P \quad (1).$$

46. A numerically controlled machine tool, robot, or injection molding machine, characterized by using, as a power cable for a motor, the HF leakage current return wire-contained motor drive cable as defined in claim 45.

47. The HF leakage current return wire-contained motor drive cable configured from the three drive insulated wires and the three HF leakage current return wires arranged adjacent to and in close contact with the respective insulated wires, as defined in claim 35, the drive cable being characterized in that, where a center of the triangle is O, a distance from the center O to a center of the respective HF leakage current return wire in the case where the respective HF leakage current return wire is arranged in contact with both of two adjacent drive insulated wires of the three drive insulated wires are r1, r2, and r3 (r1≈r2≈r3), and a closest distance is R, a largest distance (such as r1) having a largest value among the distances r1, r2, and r3 in the case where the respective HF leakage current return wires are actually arranged is caused to fall within expression (2):

$$R\leqq r1<1.35R \quad (2).$$

48. A numerically controlled machine tool, robot, or injection molding machine, characterized by using, as a power cable for a motor, the HF leakage current return wire-contained motor drive cable as defined in claim 47.

49. The HF leakage current return wire-contained motor drive cable configured from the three drive insulated wires and the three HF leakage current return wires arranged adjacent to and in close contact with the respective insulated wires, as defined in claim 35, the drive cable being characterized in that, where a straight line interconnecting the center O of the triangle to the center of the respective HF leakage current return wire in the case where the respective HF leakage current return wire is arranged in contact with both of two adjacent drive insulated wires of the three drive insulated wires is a reference line, a range of an offset angle α with respect to the reference line interconnecting the center O and the center of the respective HF leakage current return wire in the case where the respective HF leakage current return wires are actually arranged is caused to fall within expression (3):

$$-5°<\alpha<+5° \quad (3).$$

50. A numerically controlled machine tool, robot, or injection molding machine, characterized by using, as a power cable for a motor, the HF leakage current return wire-contained motor drive cable as defined in claim 49.

51. A numerically controlled machine tool, robot, or injection molding machine, characterized by using, as a power cable for a motor, the HF leakage current return wire-contained motor drive cable as defined in claim 35.

52. A motor drive control system comprising:

an inverter; and a motor working as a driven control device to be driven by the inverter, the inverter and motor being interconnected by a high frequency (HF) leakage current return wire-contained drive cable in which the inductance is caused to be low, wherein an HF leakage current caused on the side of the motor due to an HF switching pulse associated with the inverter is efficiently returned by the drive cable to the side of the inverter.

* * * * *